US009299354B2

(12) United States Patent
Takeuchi et al.

(10) Patent No.: US 9,299,354 B2
(45) Date of Patent: Mar. 29, 2016

(54) AUDIO ENCODING DEVICE AND AUDIO ENCODING METHOD

(71) Applicant: FUJITSU LIMITED, Kawasaki-shi, Kanagawa (JP)

(72) Inventors: Shunsuke Takeuchi, Kawasaki (JP); Yohei Kishi, Kawasaki (JP); Masanao Suzuki, Yokohama (JP); Miyuki Shirakawa, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 309 days.

(21) Appl. No.: 13/916,848

(22) Filed: Jun. 13, 2013

(65) Prior Publication Data

US 2014/0006035 A1 Jan. 2, 2014

(30) Foreign Application Priority Data

Jun. 29, 2012 (JP) ..... 2012-147500

(51) Int. Cl.
*G10L 19/00* (2013.01)
*G10L 19/008* (2013.01)

(52) U.S. Cl.
CPC ..... *G10L 19/008* (2013.01)

(58) Field of Classification Search
CPC ..... G10L 19/18; G10L 19/008; G10L 19/04; G10L 19/24; G10L 19/12; G10L 19/22; G10L 19/0017; G10L 19/0208; G10L 25/18; G10L 19/26; G10L 19/018; G10L 25/12; H04B 1/7075; H04B 1/70753; H04B 7/0689; H04B 7/0669
USPC ..... 704/500–504, 219–230
See application file for complete search history.

(56) References Cited

U.S. PATENT DOCUMENTS

| | | | | |
|---|---|---|---|---|
| 2006/0140412 | A1 | 6/2006 | Villemoes et al. | |
| 2009/0210234 | A1 * | 8/2009 | Sung et al. | 704/500 |
| 2010/0014679 | A1 * | 1/2010 | Kim et al. | 381/23 |
| 2010/0241436 | A1 * | 9/2010 | Kim et al. | 704/500 |

FOREIGN PATENT DOCUMENTS

JP 2008-517338 5/2008

* cited by examiner

*Primary Examiner* — Huyen Vo
(74) *Attorney, Agent, or Firm* — Oblon, McClelland, Maier & Neustadt, L.L.P

(57) ABSTRACT

An audio encoding device includes a processor; and a memory which stores a plurality of instructions, which when executed by the processor, cause the processor to execute, calculating first phases indicating phases of a first channel signal and a second channel signal included in audio signals of a plurality of channels; and performing, on the basis of the first phases, either first predictive coding in which a third channel signal included in the audio signals of the plurality of channels is predicted using the first channel signal and the second channel signal or second predictive coding in which the second channel signal is predicted using the first channel signal.

18 Claims, 13 Drawing Sheets

FIG. 2

| | | | | | | | | | | | | |
|---|---|---|---|---|---|---|---|---|---|---|---|---|
| idx | -20 | -19 | -18 | -17 | -16 | -15 | -14 | -13 | -12 | -11 | -10 | 201 |
| c [idx] | -2.0 | -1.9 | -1.8 | -1.7 | -1.6 | -1.5 | -1.4 | -1.3 | -1.2 | -1.1 | -1.0 | 202 |
| idx | -9 | -8 | -7 | -6 | -5 | -4 | -3 | -2 | -1 | 0 | 1 | 203 |
| c [idx] | -0.9 | -0.8 | -0.7 | -0.6 | -0.5 | -0.4 | -0.3 | -0.2 | -0.1 | 0.0 | 0.1 | 204 |
| idx | 2 | 3 | 4 | 5 | 6 | 7 | 8 | 9 | 10 | 11 | 12 | 205 |
| c [idx] | 0.2 | 0.3 | 0.4 | 0.5 | 0.6 | 0.7 | 0.8 | 0.9 | 1.0 | 1.1 | 1.2 | 206 |
| idx | 13 | 14 | 15 | 16 | 17 | 18 | 19 | 20 | 21 | 22 | 23 | 207 |
| c [idx] | 1.3 | 1.4 | 1.5 | 1.6 | 1.7 | 1.8 | 1.9 | 2.0 | 2.1 | 2.2 | 2.3 | 208 |
| idx | 24 | 25 | 26 | 27 | 28 | 29 | 30 | 209 | | | | |
| c [idx] | 2.4 | 2.5 | 2.6 | 2.7 | 2.8 | 2.9 | 3.0 | 210 | | | | |

200

FIG. 4

| idx | 0 | 1 | 2 | 3 | 4 | 5 | 6 | 7 | 410 |
|---|---|---|---|---|---|---|---|---|---|
| ICC[idx] | 1 | 0.937 | 0.84118 | 0.60092 | 0.36764 | 0 | -0.589 | -0.99 | 420 |

400

| DIFFERENCE VALUE | idxicci |
|---|---|
| -7 | 11111111111111 |
| -6 | 111111111111110 |
| -5 | 111111111110 |
| -4 | 1111111110 |
| -3 | 1111110 |
| -2 | 11110 |
| -1 | 110 |
| 0 | 0 |

| DIFFERENCE VALUE | idxicci |
|---|---|
| 1 | 10 |
| 2 | 1110 |
| 3 | 111110 |
| 4 | 11111110 |
| 5 | 111111110 |
| 6 | 11111111110 |
| 7 | 1111111111110 |

FIG. 6

| | | | | | | | | | | | | |
|---|---|---|---|---|---|---|---|---|---|---|---|---|
| Idx | -15 | -14 | -13 | -12 | -11 | -10 | -9 | -8 | -7 | -6 | -5 | 610 |
| CLD[idx] | -150 | -45 | -40 | -35 | -30 | -25 | -22 | -19 | -16 | -13 | -10 | 620 |
| Idx | -4 | -3 | -2 | -1 | 0 | 1 | 2 | 3 | 4 | 5 | 6 | 630 |
| CLD[idx] | -8 | -6 | -4 | -2 | 0 | 2 | 4 | 6 | 8 | 10 | 13 | 640 |
| Idx | 7 | 8 | 9 | 10 | 11 | 12 | 13 | 14 | 15 | 650 | | |
| CLD[idx] | 16 | 19 | 22 | 25 | 30 | 35 | 40 | 45 | 150 | 660 | | |

600

AUDIO ENCODING DEVICE AND AUDIO ENCODING METHOD

CROSS-REFERENCE TO RELATED APPLICATION

This application is based upon and claims the benefit of priority of the prior Japanese Patent Application No. 2012-147500, filed on Jun. 29, 2012, the entire contents of which are incorporated herein by reference.

FIELD

The embodiments discussed herein are related to, for example, an audio encoding device, an audio encoding method, a computer-readable recording medium storing an audio encoding computer program, and an audio decoding device.

BACKGROUND

Currently, methods for encoding an audio signal that compress the amount of data of multichannel audio signals of three or more channels are being developed. As one of such encoding methods, an MPEG Surround method standardized by the Moving Picture Experts Group (MPEG) is known. In the MPEG Surround method, for example, 5.1-channel (5.1ch) audio signals to be encoded are subjected to a time-frequency transform, and frequency signals obtained by the time-frequency transform are downmixed, thereby generating frequency signals of three channels. The frequency signals of the three channels are further downmixed, and, as a result, frequency signals corresponding to stereophonic signals of two channels are calculated. The frequency signals corresponding to the stereophonic signals are then encoded using an Advanced Audio Coding (AAC) encoding method and a Spectral Band Replication (SBR) encoding method. On the other hand, in the MPEG Surround method, when the 5.1ch signals are downmixed to generate the signals of the three channels and when the signals of the three channels are downmixed to generate the signals of the two channels, spatial information indicating the diffusion of a sound or the location of a sound is calculated and encoded. Thus, in the MPEG Surround method, the stereophonic signals generated by downmixing the multichannel audio signals and the spatial information whose amount of data is relatively small are encoded. Therefore, in the MPEG Surround method, the efficiency of compression higher than in a case in which the signal of each channel included in the multichannel audio signals is separately encoded.

In the MPEG Surround method, in order to reduce the amount of information to be encoded, the frequency signals of the three channels are divided into stereophonic frequency signals and two channel prediction coefficients and encoded. The channel prediction coefficients are coefficients for performing predictive coding on a signal of one of the three channels on the basis of the signals of the other two channels. A plurality of channel prediction coefficients are stored in a table called a "code book". The code book is used to improve the efficiency of bits used. When an encoder and a decoder have a predetermined common code book (or a code book created using a common method), important information may be transmitted with a smaller number of bits. In decoding, a signal of one of the three channels is reproduced on the basis of the channel prediction coefficients. Therefore, in encoding, the channel prediction coefficients are selected from the code book.

As a method for selecting the channel prediction coefficients from the code book, a method has been disclosed in which an error defined by a difference between a channel signal before predictive coding and a channel signal after the predictive coding is calculated using all the channel prediction coefficients stored in the code book, and a channel prediction coefficient with which the error caused by the predictive coding becomes smallest is selected. In Japanese National Publication of International Patent Application No. 2008-517338, a method is disclosed in which a channel prediction coefficient with which an error becomes smallest is calculated using a calculation method adopting a method of least squares.

SUMMARY

In accordance with an aspect of the embodiments, an audio encoding device includes a processor; and a memory which stores a plurality of instructions, which when executed by the processor, cause the processor to execute, calculating first phases indicating phases of a first channel signal and a second channel signal included in audio signals of a plurality of channels; and performing, on the basis of the first phases, either first predictive coding in which a third channel signal included in the audio signals of the plurality of channels is predicted using the first channel signal and the second channel signal or second predictive coding in which the second channel signal is predicted using the first channel signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 2 is a diagram illustrating an example of a quantization table for channel prediction coefficients;

FIG. 4 is a diagram illustrating an example of a quantization table for degrees of similarity;

FIG. 6 is a diagram illustrating an example of a quantization table for differences in intensity;

DESCRIPTION OF EMBODIMENTS

An audio encoding device, an audio encoding method, an audio encoding computer program, and an audio decoding device according to embodiments will be described in detail hereinafter with reference to the drawings. These embodiments do not limit the technology disclosed herein.

Figure 1:
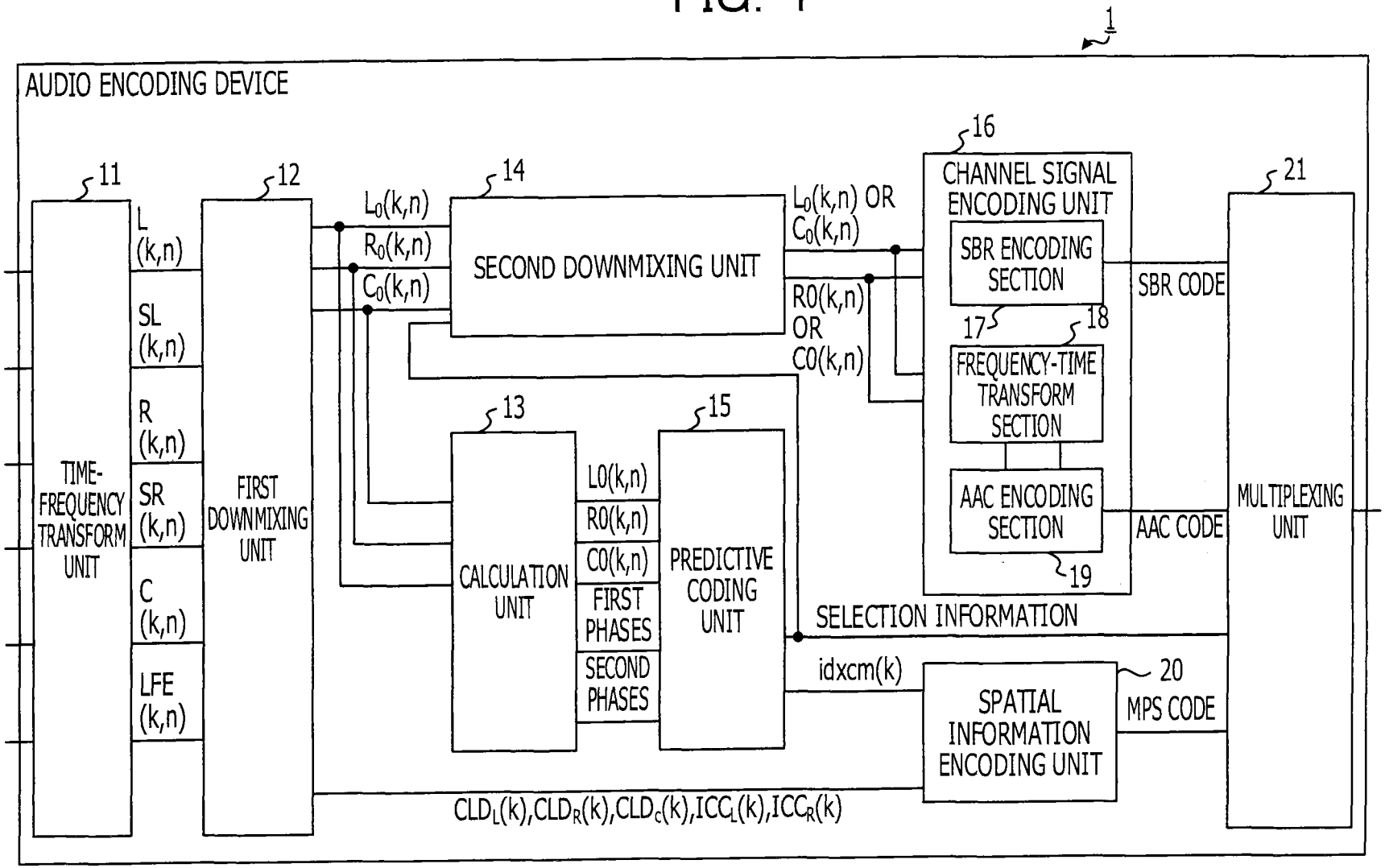
FIG. 1 is a diagram illustrating the functional blocks of an audio encoding device according to an embodiment.

(First Embodiment) FIG. 1 is a diagram illustrating the functional blocks of an audio encoding device 1 according to an embodiment. As illustrated in FIG. 1, the audio encoding device 1 includes a time-frequency transform unit 11, a first downmixing unit 12, a calculation unit 13, a second downmixing unit 14, a predictive coding unit 15, a channel signal encoding unit 16, a spatial information encoding unit 20, and a multiplexing unit 21. The channel signal encoding unit 16 includes an SBR encoding section 17, a frequency-time transform section 18, and an MC encoding section 19.

These components included in the audio encoding device 1 are formed as separate circuits. Alternatively, these components included in the audio encoding device 1 may be mounted on the audio encoding device 1 as a single integrated circuit in which circuits corresponding thereto are integrated with one another. Alternatively, these components included in the audio encoding device 1 may be function modules realized by a computer program executed by a processor included in the audio encoding device 1.

The time-frequency transform unit 11 transforms a signal of each channel of multichannel audio signals in a time domain input to the audio encoding apparatus 1 into a frequency signal of each channel by performing a time-frequency transform for each frame. In the present embodiment, the time-frequency transform unit 11 transforms a signal of each channel into a frequency signal using a quadrature mirror filter (QMF) bank represented by the following expression:

$$QMF(k, n) = \exp\left[j\frac{\pi}{128}(k+0.5)(2n+1)\right], \quad 0 \le k < 64,\ 0 \le n < 128 \tag{1}$$

Here, n is a variable denoting time, that is, an n-th time when an audio signal of one frame is divided into 128 pieces in a time direction. A frame length may be, for example, within a range of 10 to 80 ms. k is a variable denoting a frequency band, that is, a k-th frequency band when a frequency band included in a frequency signal is divided into 64 pieces. QMF(k, n) is a QMF for outputting a frequency signal of a time n and a frequency band k. The time-frequency transform unit 11 multiplies an input audio signal of one frame of a channel by QMF(k, n) to generate a frequency signal of the channel. Alternatively, the time-frequency transform unit 11 may transform a signal of each channel into a frequency signal by using another time-frequency transform process such as a fast Fourier transform, a discrete cosine transform, or a modified discrete cosine transform (MDCT).

Each time the time-frequency transform unit 11 has calculated a frequency signal of each channel for each frame, the time-frequency transform unit 11 outputs the frequency signal of each channel to the first downmixing unit 12.

Each time the first downmixing unit 12 has received a frequency signal of each channel, the first downmixing unit 12 downmixes the frequency signal of each channel to generate frequency signals of a left channel, a center channel, and a right channel. For example, the first downmixing unit 12 calculates the frequency signals of the three channels in accordance with the following expressions:

$$L_{in}(k, n)=L_{in_{Re}}(k, n)+j\cdot L_{inIm}(k, n)\ 0\le k<64,\ 0\le n<128$$

$$L_{in_{Re}}(k, n)=L_{Re}(k, n)+SL_{Re}(k, n)$$

$$L_{inIm}(k, n)=L_{Im}(k, n)+SL_{Im}(k, n)$$

$$R_{in}(k, n)=R_{in_{Re}}(k, n)+j\cdot R_{inIm}(k, n)$$

$$R_{in_{Re}}(k, n)=R_{Re}(k, n)+SR_{Re}(k, n)$$

$$R_{inIm}(k, n)=R_{Im}(k, n)+SR_{Im}(k, n)$$

$$C_{in}(k, n)=C_{in_{Re}}(k, n)+j\cdot C_{inIm}(k, n)$$

$$C_{in_{Re}}(k, n)=C_{Re}(k, n)+LFE_{Re}(k, n)$$

$$C_{inIm}(k, n)=C_{Im}(k, n)+LFE_{Im}(k, n) \tag{2}$$

Here, $L_{Re}(k, n)$ denotes a real part of a frequency signal L(k, n) of a left front channel, and $L_{Im}(k, n)$ denotes an imaginary part of the frequency signal L(k, n) of the left front channel. $SL_{Re}(k, n)$ denotes a real part of a frequency signal SL(k, n) of a left rear channel, and $SL_{Im}(k, n)$ denotes an imaginary part of the frequency signal SL(k, n) of the left rear channel. $L_{in}(k, n)$ denotes a frequency signal of the left channel generated by the downmixing. $L_{inRe}(k, n)$ denotes a real part of the frequency signal of the left channel, and $L_{inIm}(k, n)$ denotes an imaginary part of the frequency signal of the left channel.

Similarly, $R_{Re}(k, n)$ denotes a real part of a frequency signal R(k, n) of a right front channel, and $R_{Im}(k, n)$ denotes an imaginary part of the frequency signal R(k, n) of the right front channel. $SR_{Re}(k, n)$ denotes a real part of a frequency signal SR(k, n) of a right rear channel, and $SR_{Im}(k, n)$ denotes an imaginary part of the frequency signal SR(k, n) of the right rear channel. $R_{in}(k, n)$ denotes a frequency signal of the right channel generated by the downmixing. $R_{inRe}(k, n)$ denotes a real part of the frequency signal of the right channel, and $R_{inIm}(k, n)$ denotes an imaginary part of the frequency signal of the right channel.

Furthermore, $C_{Re}(k, n)$ denotes a real part of a frequency signal C(k, n) of a center channel, and $C_{Im}(k, n)$ denotes an imaginary part of the frequency signal C(k, n) of the center channel. $LFE_{Re}(k, n)$ denotes a real part of a frequency signal LFE(k, n) of a low-frequency effects channel, and $LFE_{Im}(k, n)$ denotes an imaginary part of the frequency signal LFE(k, n) of the low-frequency effects channel. $C_{in}(k, n)$ denotes a frequency signal of the center channel generated by the downmixing. $C_{inRe}(k, n)$ denotes a real part of the frequency signal $C_{in}(k, n)$ of the center channel, and $C_{inIm}(k, n)$ denotes an imaginary part of the frequency signal $C_{in}(k, n)$ of the center channel.

The first downmixing unit 12 calculates, as spatial information between frequency signals of two channels to be downmixed, a difference in intensity between the frequency signals, which is information indicating the location of a sound, and a degree of similarity between the frequency signals, which is information indicating the diffusion of a sound, for each frequency band. These pieces of spatial information calculated by the first downmixing unit 12 are example of three-channel spatial information. In the present embodiment, the first downmixing unit 12 calculates a difference in intensity $CLD_L(k)$ and a degree of similarity $ICC_L(k)$ of the frequency band k for the left channel in accordance with the following expressions:

$$CLD_L(k) = 10\log_{10}\left(\frac{e_L(k)}{e_{SL}(k)}\right) \tag{3}$$

$$ICC_L(k) = \mathrm{Re}\left\{\frac{e_{LSL}(k)}{\sqrt{e_L(k) \cdot e_{SL}(k)}}\right\}$$

$$e_L(k) = \sum_{n=0}^{N-1} |L(k, n)|^2 \tag{4}$$

$$e_{SL}(k) = \sum_{n=0}^{N-1} |SL(k, n)|^2$$

$$e_{LSL}(k) = \sum_{n=0}^{N-1} L(k, n) \cdot SL(k, n)$$

Here, N is the number of samples in the time direction included in one frame, which is 128 in the present embodiment. $e_L(k)$ is an autocorrelation value of the frequency signal L(k, n) of the left front channel, and $e_{SL}(k)$ is an autocorrelation value of the frequency signal SL(k, n) of the left rear channel. $e_{LSL}(k)$ is a cross-correlation value of the frequency signal L(k, n) of the left front channel and the frequency signal SL(k, n) of the left rear channel.

Similarly, the first downmixing unit 12 calculates a difference in intensity $CLD_R(k)$ and a degree of similarity $ICC_R(k)$ of the frequency band k for the right channel in accordance with the following expressions:

$$CLD_R(k) = 10\log_{10}\left(\frac{e_R(k)}{e_{SR}(k)}\right) \tag{5}$$

$$ICC_R(k) = \mathrm{Re}\left\{\frac{e_{RSR}(k)}{\sqrt{e_R(k) \cdot e_{SR}(k)}}\right\}$$

$$e_R(k) = \sum_{n=0}^{N-1} |R(k, n)|^2 \tag{6}$$

$$e_{SR}(k) = \sum_{n=0}^{N-1} |SR(k, n)|^2$$

$$e_{RSR}(k) = \sum_{n=0}^{N-1} L(k, n) \cdot SR(k, n)$$

Here, $e_R(k)$ is an autocorrelation value of the frequency signal R(k, n) of the right front channel, and $e_{SR}(k)$ is an autocorrelation value of the frequency signal SR(k, n) of the right rear channel. $e_{RSR}(_k)$ is a cross-correlation value of the frequency signal R(k, n) of the right front channel and the frequency signal SR(k, n) of the right rear channel.

Furthermore, the first downmixing unit 12 calculates a difference in intensity $CLD_C(k)$ of the frequency band k for the center channel in accordance with the following expressions:

$$CLD_C(k) = 10\log_{10}\left(\frac{e_C(k)}{e_{LFE}(k)}\right) \tag{7}$$

$$e_C(k) = \sum_{n=0}^{N-1} |C(k, n)|^2$$

$$e_{LFE}(k) = \sum_{n=0}^{N-1} |LFE(k, n)|^2$$

Here, $e_C(k)$ is an autocorrelation value of the frequency signal C(k, n) of the center channel, and $e_{LFE}(k)$ is an autocorrelation value of the frequency signal LFE(k, n) of the low-frequency effects channel.

After generating the frequency signals of the three channels, the first downmixing unit 12 further downmixes the frequency signal of the left channel and the frequency signal of the center channel to generate a left frequency signal of stereophonic frequency signals. The first downmixing unit 12 downmixes the frequency signal of the right channel and the frequency signal of the center channel to generate a right frequency signal of the stereophonic frequency signals. The first downmixing unit 12 generates a left frequency signal $L_0(k, n)$ and a right frequency signal $R_0(k, n)$ of the stereophonic frequency signals in accordance with, for example, the following expression. Furthermore, for example, the first downmixing unit 12 calculates a signal $C_0(k, n)$ of the center channel used to select a channel prediction coefficient included in a code book in accordance with the following expression:

$$\begin{pmatrix} L_0(k, n) \\ R_0(k, n) \\ C_0(k, n) \end{pmatrix} = \begin{pmatrix} 1 & 0 & \frac{\sqrt{2}}{2} \\ 0 & 1 & \frac{\sqrt{2}}{2} \\ 1 & 1 & -\frac{\sqrt{2}}{2} \end{pmatrix} \begin{pmatrix} L_{in}(k, n) \\ R_{in}(k, n) \\ C_{in}(k, n) \end{pmatrix} \tag{8}$$

Here, $L_{in}(k, n)$, $R_{in}(k, n)$, and $C_{in}(k, n)$ are the frequency signals of the left channel, the right channel, and the center channel, respectively, generated by the first downmixing unit 12. The left frequency signal $L_0(k, n)$ is a combination between the frequency signals of the left front channel, the left rear channel, the center channel, and the low-frequency effects channel of the original multichannel audio signals. Similarly, the right frequency signal $R_0(k, n)$ is a combination between the frequency signals of the right front channel, the right rear channel, the center channel, and the low-frequency effects channel of the original multichannel audio signals.

The first downmixing unit 12 outputs the left frequency signal $L_0(k, n)$, the right frequency signal $R_0(k, n)$, and the signal $C_0(k, n)$ of the center channel to the calculation unit 13 and the second downmixing unit 14. The first downmixing unit 12 also outputs the differences in intensity $CLD_L(k)$, $CLD_R(k)$, and $CLD_C(k)$ and the degrees of similarity $ICC_L(k)$ and $ICC_R(k)$, which are the spatial information, to the spatial information encoding unit 20.

The calculation unit 13 receives the frequency signals of the three channels, namely the left frequency signal $L_0(k, n)$, the right frequency signal $R_0(k, n)$, and the signal $C_0(k, n)$ of the center channel, from the first downmixing unit 12. The calculation unit 13 then calculates first phases, which indicate the phases of the left frequency signal $L_0(k, n)$ and the right frequency signal $R_0(k, n)$. The calculation unit 13 also calculates second phases, which indicate the phases of the left frequency signal $L_0(k, n)$ or the right frequency signal $R_0(k, n)$ and the signal $C_0(k, n)$ of the center channel as occasion calls.

The calculation unit 13 outputs the left frequency signal $L_0(k, n)$, the right frequency signal $R_0(k, n)$, the signal $C_0(k, n)$ of the center channel, and the first phases to the predictive coding unit 15. The calculation unit 13 also outputs the second phases to the predictive coding unit 15 as occasion calls. Details of the reason why the calculation unit 13 calculates the first phases and the second phases will be described later, but these phases are used by the predictive coding unit 15 to determine whether or not it is possible to perform predictive coding of the signal $C_0(k, n)$ of the center channel using the left frequency signal $L_0(k, n)$ and the right frequency signal $R_0(k, n)$ (whether or not an error will be significantly large).

Here, a specific method for calculating the first phases and the second phases used by the calculation unit 13 will be described. First, a case in which the first phases are calculated will be described. By expanding the left frequency signal $L_0(k, n)$ and the right frequency signal $R_0(k, n)$ described in the expression 8, the following expressions are obtained:

$$L_0(k, n) = \left(L_{inRe}(k, n) + \frac{\sqrt{2}}{2} C_{inRe}(k, n)\right) + \left(L_{inIm}(k, n) + \frac{\sqrt{2}}{2} C_{inIm}(k, n)\right) \tag{9}$$

$$R_0(k, n) = \left(R_{inRe}(k, n) + \frac{\sqrt{2}}{2} C_{inRe}(k, n)\right) + \left(R_{inIm}(k, n) + \frac{\sqrt{2}}{2} C_{inIm}(k, n)\right)$$

Now, substitute the expression 9 for the following expressions:

$$a(k, n) = L_{inRe}(k, n) + \frac{\sqrt{2}}{2} C_{inRe}(k, n)$$

$$b_i(k, n) = L_{inIm}(k, n) + \frac{\sqrt{2}}{2} C_{inIm}(k, n)$$

$$c(k, n) = R_{inRe}(k, n) + \frac{\sqrt{2}}{2} C_{inRe}(k, n)$$

$$d_i(k, n) = R_{inIm}(k, n) + \frac{\sqrt{2}}{2} C_{inIm}(k, n)$$

As a result, $\cos\theta_1$, which corresponds to the first phases, may be calculated by the following expression:

$$\cos\theta_1 = \frac{a(k, n) \cdot c(k, n) + b_i(k, n) \cdot d_i(k, n)}{\sqrt{a(k, n)^2 + b_i(k, n)^2}\sqrt{c(k, n)^2 + d_i(k, n)^2}} \tag{10}$$

Here, if the value of $\cos\theta_1$ is −1, the first phases are opposite phases, and if the value of $\cos\theta_1$ is 1, the first phases are identical phases. Calculation of the second phases may be performed in the same manner as the calculation of the first phases, and therefore detailed description thereof is omitted.

The second downmixing unit 14 downmixes two of the frequency signals of the three channels received from the first downmixing unit 12, namely the left frequency signal $L_0(k, n)$, the right frequency signal $R_0(k, n)$, and the signal $C_0(k, n)$ of the center channel, to generate stereophonic frequency signals of two channels. The second downmixing unit 14 then outputs the generated stereophonic frequency signals to the channel signal encoding unit 16. Details of the operation of the second downmixing unit 14 will be described later.

The predictive coding unit 15 selects channel prediction coefficients for the frequency signals of the two channels downmixed by the second downmixing unit 14 from the code book. For convenience of description, predictive coding of the signal $C_0(k, n)$ of the center channel based on the right frequency signal $R_0(k, n)$ and the left frequency signal $L_0(k, n)$ will be referred to as first predictive coding. When the predictive coding unit 15 performs the first predictive coding, the second downmixing unit 14 downmixes the left frequency signal $L_0(k, n)$ and the right frequency signal $R_0(k, n)$ to generate the stereophonic frequency signals of the two channels. When the first phases are other than identical phases and opposite phases, the predictive coding unit 15 performs the first predictive coding, the reason for which will be described later. When performing the first predictive coding, the predictive coding unit 15 selects, for each frequency band, channel prediction coefficients $c_1(k)$ and $c_2(k)$ with which an error $d(k)$ between frequency signals before and after the predictive coding defined by the following expressions on the basis of $C_0(k, n)$, $L_0(k, n)$, and $R_0(k, n)$ becomes smallest from the code book. Thus, the predictive coding unit 15 generates a signal $C'_0(k, n)$ of the center channel after the predictive coding by performing the predictive coding.

$$d(k) = \sum_k \sum_n \{|C_0(k, n) - C'_0(k, n)|^2\} \tag{11}$$

$$C'_0(k, n) = c_1(k) \cdot L_0(k, n) + c_2(k) \cdot R_0(k, n)$$

The predictive coding unit 15 refers to a quantization table, which is included in the predictive coding unit 15, representing correspondences between typical values of the channel prediction coefficients $c_1(k)$ and $c_2(k)$ and index values using the channel prediction coefficients $c_1(k)$ and $c_2(k)$ included in the code book. The predictive coding unit 15 determines index values closest to the channel prediction coefficients $c_1(k)$ and $c_2(k)$ for each frequency band by referring to the quantization table. Here, a specific example will be described. FIG. 2 is a diagram illustrating an example of the quantization table for channel prediction coefficients. In a quantization table 200 illustrated in FIG. 2, each field in rows 201, 203, 205, 207, and 209 indicates an index value. On the other hand, each field in rows 202, 204, 206, 208, and 210 indicates a typical value of the channel prediction coefficient corresponding to the index value indicated in each field in the same column of the rows 201, 203, 205, 207, and 209, respectively. For example, when the channel prediction coefficient $c_1(k)$ for the frequency band k is 1.21, an index value of 12 is the closest to the channel prediction coefficient $c_1(k)$ in the quantization table 200. Therefore, the predictive coding unit 15 sets the index value for the channel prediction coefficient $c_1(k)$ to 12.

Next, the predictive coding unit 15 calculates, for each frequency band, a difference value between index values in a frequency direction. For example, if the index value for the frequency band k is 2 and the index value for a frequency band (k-1) is 4, the predictive coding unit 15 determines the difference value between the index values for the frequency band k as −2.

Next, the predictive coding unit 15 refers to a coding table representing correspondences between difference values between index values and channel prediction coefficient codes. The predictive coding unit 15 determines a channel prediction coefficient code $idxc_m(k)$ (m=1, 2 or m=1) for the difference value for each frequency band in the case of the channel prediction coefficient $c_m(k)$ (m=1, 2 or m=1) by referring to the coding table. The predictive coefficient code may be, for example, as with a similarity code, a variable-length code whose code length becomes short as the frequency of occurrence of the difference value becomes high, such as a Huffman code or an arithmetic code. The quantization table and the coding table are stored in advance in a memory, which is not illustrated, included in the predictive coding unit 15. In FIG. 1, the predictive coding unit 15 outputs the channel prediction coefficient code $idxc_m(k)$ (m=1, 2 or m=1) to the spatial information encoding unit 20

Figure 3A:
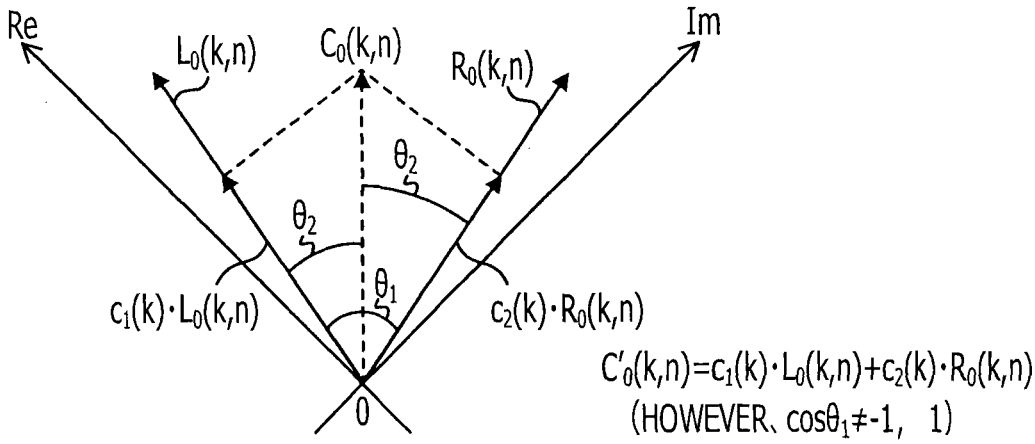
FIG. 3A is a conceptual diagram illustrating first predictive coding.

Now, the reason why there is a case in which when the predictive coding unit 15 has performed the first predictive coding, the error d(k) caused by the expression 11 becomes significantly large, and therefore it is difficult to properly perform the predictive coding, which has been newly found out by the present inventors, will be described. FIG. 3A is a conceptual diagram illustrating the first predictive coding. In FIG. 3A, an Re axis and an Im axis, which are coordinate axes, represent the real part and the imaginary part, respectively, of a frequency signal. As represented by the expressions 2, 8, 9, and the like, the left frequency signal $L_0(k, n)$, the right frequency signal $R_0(k, n)$, and the signal $C_0(k, n)$ of the center channel may be each represented by a vector including the real part and the imaginary part.

FIG. 3A schematically illustrates the vector of the left frequency signal $L_0(k, n)$, the vector of the right frequency signal $R_0(k, n)$, and the vector of the signal $C_0(k, n)$ of the center channel to be subjected to the predictive coding. The first predictive coding utilizes the characteristic of the signal $C_0(k, n)$ of the center channel that the signal $C_0(k, n)$ of the center channel may be subjected to vector decomposition using the left frequency signal $L_0(k, n)$, the vector of the right frequency signal $R_0(k, n)$, and the channel prediction coefficients $c_1(k)$ and $c_2(k)$.

Here, the predictive coding unit 15 may perform the predictive coding on the signal $C_0(k, n)$ of the center channel by selecting, from the coding book, the channel prediction coefficients $c_1(k)$ and $c_2(k)$ with which the error d(k) between the signal $C_0(k, n)$ of the center channel before the predictive coding and the signal $C_0(k, n)$ of the center channel after the predictive coding becomes smallest. This concept is represented by the expressions described in the expression 9. A cosine function $\cos\theta_1$ of the vector of the left frequency signal $L_0(k, n)$ and the vector of the right frequency signal $R_0(k, n)$ corresponds to the first phases indicating the phases of the left frequency signal $L_0(k, n)$ and the right frequency signal $R_0(k, n)$. A cosine function $\cos\theta_2$ of the vector of the left frequency signal $L_0(k, n)$ or the vector of the right frequency signal $R_0(k, n)$ and the vector of the signal $C_0(k, n)$ of the center channel corresponds to the second phases indicating the phases of the signal $C_0(k, n)$ of the center channel and the left frequency signal $L_0(k, n)$ or the right frequency signal $R_0(k, n)$.

Because the signal $C_0(k, n)$ of the center channel may be decomposed into the vector of the left frequency signal $L_0(k, n)$ and the vector of the right frequency signal $R_0(k, n)$ when the first phases are other than identical phases or opposite phases, the predictive coding unit 15 may perform the first predictive coding while giving the first predictive coding priority over second predictive coding and the like, which will be described later. This is because the left frequency signal $L_0(k, n)$ and the right frequency signal $R_0(k, n)$ generally have a high degree of similarity, and therefore the efficiency of the coding performed by the channel signal encoding unit 16 illustrated in FIG. 1 is high.

Figure 3B:
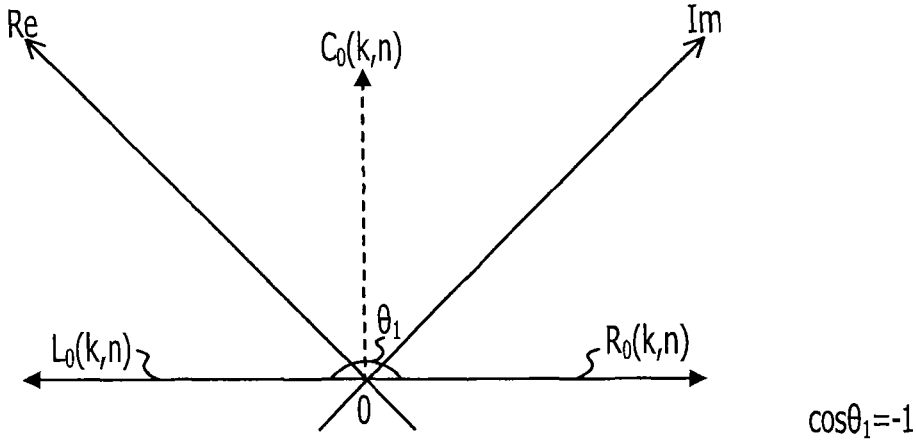
FIG. 3B is a first conceptual diagram illustrating second predictive coding.

FIG. 3B is a first conceptual diagram illustrating the second predictive coding. The definition of the second predictive coding will be described later. In FIG. 3B, the cosine function $\cos\theta_1$ of the vector of the left frequency signal $L_0(k, n)$ and the vector of the right frequency signal $R_0(k, n)$ is 180°, which indicates that the first phases are opposite phases. In this case, even if the first predictive coding is performed, it is difficult to decompose the signal $C_0(k, n)$ of the center channel into the vector of the left frequency signal $L_0(k, n)$ and the vector of the right frequency signal $R_0(k, n)$ unless the first phases and the second phases are identical phases or opposite phases. Therefore, a problem arises in that the error d(k) caused by the expression 9 becomes significantly large and accordingly it is difficult to properly perform the predictive coding, which has been newly found out by the present inventors.

However, in FIG. 3B, the cosine function $\cos\theta_1$ of the vector of the left frequency signal $L_0(k, n)$ and the vector of the right frequency signal $R_0(k, n)$ is 180°. Therefore, the right frequency signal $R_0(k, n)$ may be subjected to the predictive coding by utilizing the vector of the left frequency signal $L_0(k, n)$ and by selecting, from the code book, the channel prediction coefficient $c_1(k)$ with which the error d(k) caused by the predictive coding becomes smallest. A right frequency signal $R'_0(k, n)$ after the predictive coding may be represented by the following expressions:

$$d(k) = \sum_k \sum_n \{|R_0(k, n) - R'_0(k, n)|^2\} \tag{12}$$

$$R'_0(k, n) = c_1(k) \cdot L_0(k, n)$$

Therefore, even when it is difficult to decompose the signal $C_0(k, n)$ of the center channel into the vector of the left frequency signal $L_0(k, n)$ and the vector of the right frequency signal $R_0(k, n)$ (when it is difficult to properly perform the predictive coding on the signal $C_0(k, n)$ of the center channel), the right frequency signal $R_0(k, n)$ may be properly subjected to the predictive coding by utilizing the vector of the left frequency signal $L_0(k, n)$ in the second predictive coding. By performing the predictive coding not on the signal $C_0(k, n)$ of the center channel but on the right frequency signal $R_0(k, n)$ in the second predictive coding, the error caused by the predictive coding may be suppressed.

Alternatively, the predictive coding unit 15 may perform the predictive coding on the left frequency signal $L_0(k, n)$ by utilizing the vector of the right frequency signal $R_0(k, n)$ and by selecting, from the code book, the channel prediction coefficient $c_1(k)$ with which the error d(k) caused by the predictive coding becomes smallest. A left frequency signal $L'_0(k, n)$ after the predictive coding may be represented by the following expressions:

$$d(k) = \sum_k \sum_n \{|L_0(k, n) - L'_0(k, n)|^2\} \tag{13}$$

$$L'_0(k, n) = c_1(k) \cdot L_0(k, n)$$

The predictive coding performed on the left frequency signal $L_0(k, n)$ by utilizing the right frequency signal $R_0(k, n)$ or the predictive coding performed on the right frequency signal $R_0(k, n)$ by utilizing the left frequency signal $L_0(k, n)$ will be referred to as the second predictive coding herein for convenience of description. The predictive coding unit 15 may define the smallest error d(k) calculated from the expression 12 as a first error and the smallest error d(k) calculated from the expression 13 as a second error and compare the first and second errors, in order to perform the second predictive coding using the expression 12 or 13, whichever the error d(k) is smaller.

Figure 3C:
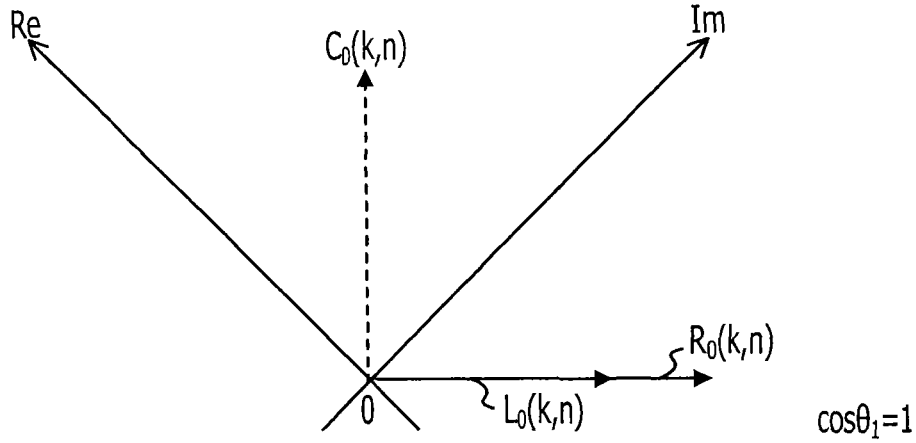
FIG. 3C is a second conceptual diagram illustrating the second predictive coding.

FIG. 3C is a second conceptual diagram illustrating the second predictive coding. In FIG. 3C, the cosine function $\cos\theta_1$ of the vector of the left frequency signal $L_0(k, n)$ and the vector of the right frequency signal $R_0(k, n)$ is 0°, which indicates that the first phases are identical phases. In this case, as in the case illustrated in FIG. 3B, even if the first predictive coding is performed, it is difficult to decompose the signal $C_0(k, n)$ of the center channel into the vector of the left frequency signal $L_0(k, n)$ and the vector of the right frequency signal $R_0(k, n)$ unless the first phases and the second phases are identical phases or opposite phases. Therefore, a problem arises in that the error d(k) caused by the expression 9 becomes significantly large and accordingly it is difficult to properly perform the predictive coding.

However, the cosine function $\cos\theta_1$ of the vector of the left frequency signal $L_0(k, n)$ and the vector of the right frequency signal $R_0(k, n)$ is 0°. Therefore, the right frequency signal $R_0(k, n)$ may be subjected to the predictive coding by, for example, utilizing the vector of the left frequency signal $L_0(k, n)$ and by selecting, from the code book, the channel prediction coefficient $c_1(k)$ with which the error d(k) caused by the predictive coding becomes smallest. The right frequency signal $R'_0(k, n)$ after the predictive coding may be represented by the expression 12.

Alternatively, the predictive coding unit 15 may perform the predictive coding on the left frequency signal $L_0(k, n)$ by utilizing the vector of the right frequency signal $R_0(k, n)$ and by selecting, from the code book, the channel prediction coefficient $c_1(k)$ with which the error d(k) caused by the predictive coding becomes smallest. The left frequency signal $L'_0(k, n)$ after the predictive coding may be represented by the expression 13.

Here, when the predictive coding unit 15 preforms the second predictive coding, the second downmixing unit 14 downmixes either the right frequency signal $R_0(k, n)$ or the left frequency signal $L_0(k, n)$ and the signal $C_0(k, n)$ of the center channel in order to generate the stereophonic frequency signals of the two channels.

In FIGS. 3A to 3C, when the first phases and the second phases are identical phases or opposite phases, the predictive coding unit 15 may perform the predictive coding on the signal $C_0(k, n)$ of the center channel on the basis of the right frequency signal $R_0(k, n)$ or the left frequency signal $L_0(k, n)$. A signal $C'_0(k, n)$ of the center channel after the predictive coding may be calculated by either of the following expressions:

$$d(k) = \sum_k \sum_n \{|C_0(k, n) - C'_0(k, n)|^2\} \tag{14}$$

$$C'_0(k, n) = c_1(k) \cdot L_0(k, n)$$

$$d(k) = \sum_k \sum_n \{|C_0(k, n) - C'_0(k, n)|^2\} \tag{15}$$

$$C'_0(k, n) = c_1(k) \cdot R_0(k, n)$$

The predictive coding unit 15 generates selection information including information indicating that the first predictive coding or the second predictive coding has been performed as the predictive coding, and outputs the selection information to the second downmixing unit 14 and the multiplexing unit 21 illustrated in FIG. 1. When the selection information includes the information indicating that the second predictive coding has been performed, information indicating which of the left frequency signal $L_0(k, n)$ and the right frequency signal $R_0(k, n)$ has been used in the predictive coding is further included in the selection information. When the predictive coding unit 15 has performed the predictive coding using the expression 14 or 15, the selection information may include information indicating that the first predictive coding has been performed. This is because it is preferable, in terms of the efficiency of the coding performed by the channel signal encoding unit 16, that the second downmixing unit 14 downmixes the right frequency signal $R_0(k, n)$ and the left frequency signal $L_0(k, n)$ to generate the stereophonic frequency signals of the two channels.

As described above, the predictive coding unit 15 may suppress the error caused by the predictive coding by performing the predictive coding on the basis of the first phases received from the calculation unit 13. Furthermore, since the number of channel prediction coefficients to be selected may be reduced to 1 when the second predictive coding is performed, a synergistic effect of reducing loads in the coding process may be produced.

The second downmixing unit 14 receives the selection information from the predictive coding unit 15 and downmixes two of the frequency signals of the three channels, namely the left frequency signal $L_0(k, n)$, the right frequency signal $R_0(k, n)$, and the signal $C_0(k, n)$ of the center channel, on the basis of the selection information, in order to generate the stereophonic frequency signals of the two channels. More specifically, when the selection information includes the information indicating that the first predictive coding has been performed, the second downmixing unit 14 outputs, for example, the left frequency signal $L_0(k, n)$ and the right frequency signal $R_0(k, n)$ to the channel signal encoding unit 16 as first stereophonic frequency signals. On the other hand, when the selection information includes the information indicating that the second predictive coding has been performed, the second downmixing unit 14 outputs, for example, the signal $C_0(k, n)$ of the center channel and either the left frequency signal $L_0(k, n)$ or the right frequency signal $R_0(k, n)$ to the channel signal encoding unit 16 as second stereophonic frequency signals.

The channel signal encoding unit 16 encodes the stereophonic frequency signals received from the second downmixing unit 14. The channel signal encoding unit 16 includes the SBR encoding section 17, the frequency-time transform section 18, and the MC encoding section 19.

Upon receiving each stereophonic frequency signal, the SBR encoding section 17 encodes a high-frequency component, which is a component included in a high-frequency band of the stereophonic frequency signal, for each channel in accordance with an SBR encoding method. In doing so, the SBR encoding section 17 generates an SBR code. For example, as disclosed in Japanese Laid-open Patent Publication No. 2008-224902, the SBR encoding section 17 replicates a low-frequency component of a frequency signal of each channel that has a strong correlation with the high-frequency component to be subjected to the SBR encoding. The low-frequency component is a component of a frequency signal of each channel included in a low-frequency band, which is lower than the high-frequency band including the high-frequency component to be subjected to the encoding performed by the SBR encoding section 17, and encoded by the MC encoding section 19, which will be described later. The SBR encoding section 17 then adjusts the power of the high-frequency component obtained by the replication in such a way as to match the power of the original high-frequency component. The SBR encoding section 17 determines, in the original high-frequency component, a component that is so different from the low-frequency component that it is difficult to approximate the high-frequency component even if the low-frequency component is replicated as auxiliary information. The SBR encoding section 17 then performs the encoding by quantizing information indicating the positional relationship between the low-frequency component used for the replication and the corresponding high-frequency component, the amount of power adjusted, and the auxiliary information. The SBR encoding section 17 outputs the SBR code, which is the encoded information, to the multiplexing unit 21.

Upon receiving each stereophonic frequency signal, the frequency-time transform section 18 transforms the stereophonic frequency signal of each channel into a stereophonic signal in the time domain. For example, when the time-frequency transform unit 11 uses a QMF bank, the frequency-time transform section 18 performs a frequency-time transform on the stereophonic frequency signal of each channel using a complex QMF bank, which is represented by the following expression:

$$IQMF(k, n) = \frac{1}{64}\exp\left(j\frac{\pi}{128}(k+0.5)(2n-255)\right), \quad 0 \le k < 64,\ 0 \le n < 128 \tag{16}$$

Here, IQMF(k, n) is a complex QMF having the time n and the frequency k as variables. When the time-frequency transform unit 11 uses another time-frequency transform process such as a fast Fourier transform, a discrete cosine transform, or an MDCT, the frequency-time transform section 18 uses an inverse transform of the time-frequency transform process. The frequency-time transform section 18 outputs a stereophonic signal of each channel obtained by performing the frequency-time transform on the frequency signal of each channel to the MC encoding section 19.

Upon receiving the stereophonic signal of each channel, the MC encoding section 19 encodes the low-frequency component of the signal of each channel in accordance with an MC encoding method in order to generate an MC code. For example, the MC encoding section 19 may use the technology disclosed in Japanese Laid-open Patent Publication No. 2007-183528. More specifically, the MC encoding section 19 generates the stereophonic frequency signal again by performing a discrete cosine transform on the received stereophonic signal of each channel. The MC encoding section 19 then calculates perceptual entropy (PE) from the regenerated stereophonic frequency signal. The PE indicates the amount of information used to quantize a certain block such that a listener does not perceive noise.

The PE has a characteristic that the value thereof becomes large for a sound whose signal level changes in a short period of time, such as an attack sound generated by a percussion instrument. Therefore, the MC encoding section 19 shortens a window for a frame for which the value of the PE becomes relatively large, and elongates the window for a block for which the value of the PE becomes relatively small. For example, a short window includes 256 samples, and a long window includes 2,048 samples. The MC encoding section 19 performs an MDCT on the stereophonic signal of each channel using a window having a determined length, in order to transform the stereophonic signal of each channel into a combination between MDCT coefficients. The MC encoding section 19 then quantizes the combination between MDCT coefficients and performs variable-length coding on the quantized combination between MDCT coefficients. The MC encoding section 19 outputs the combination between MDCT coefficients subjected to the variable-length coding and related information such as a quantization coefficient to the multiplexing unit 21 as an MC code.

The spatial information encoding unit 20 generates an MPEG Surround code (hereinafter referred to as an MPS code) from the spatial information received from the first downmixing unit 12 and the channel prediction coefficient code received from the predictive coding unit 15.

The spatial information encoding unit 20 refers to a quantization table representing correspondences between values of the degree of similarity included in the spatial information and index values. The spatial information encoding unit 20 determines an index value closest to the degree of similarity $ICC_i(k)$ (i=L, R, 0) for each frequency band by referring to the quantization table. The quantization table is stored in advance in a memory, which is not illustrated, included in the spatial information encoding unit 20.

FIG. 4 is a diagram illustrating an example of the quantization table for degrees of similarity. In a quantization table 400 illustrated in FIG. 4, each field in an upper row 410 indicates an index value, and each field in a lower row 420 indicates a typical value of the degree of similarity corresponding to the index value in the same column. The range of the degrees of similarity is −0.99 to +1. For example, if the degree of similarity corresponding to the frequency band k is 0.6, the typical value of the degree of similarity corresponding to an index value of 3 is the closest to the degree of similarity corresponding to the frequency band k in the quantization table 400. Therefore, the spatial information encoding unit 20 sets the index value for the frequency band k to 3.

Next, the spatial information encoding unit 20 calculates, for each frequency band, a difference value between index values in the frequency direction. For example, if the index value for the frequency band k is 3 and the index value for the frequency band (k-1) is 0, the spatial information encoding unit 20 determines the difference value between index values for the frequency band k as 3.

The spatial information encoding unit 20 refers to the a coding table representing correspondences between difference values between index values and similarity codes. The spatial information encoding unit 20 determines a similarity code $idxicc_i(k)$ (i=L, R, 0) for the difference value between index values for each frequency band in the case of the degree of similarity $ICC_i(k)$ (i=L, R, 0) by referring to the coding table. The coding table is stored in advance in the memory or the like included in the spatial information encoding unit 20. The similarity code may be, for example, a variable-length code whose code length becomes short as the frequency of occurrence of the difference value becomes high, such as a Huffman code or an arithmetic code.

Figure 5:
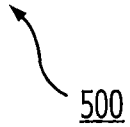
FIG. 5 is a diagram illustrating an example of a table representing relationships between difference values between index values and similarity codes.

FIG. 5 is a diagram illustrating an example of the table representing relationships between the difference values between index values and the similarity codes. In the example illustrated in FIG. 5, the similarity codes are Huffman codes. In a coding table 500 illustrated in FIG. 5, each field in a left column indicates a difference value between index values, and each field in a right column indicates a similarity code corresponding to the difference value between index values in the same row. For example, if the difference value between index values for the frequency band k is 3 in the case of the degree of similarity $ICC_L(k)$, the spatial information encoding unit 20 sets the similarity code $idxicc_L(k)$ for the frequency band k in the case of the degree of similarity $ICC_L(k)$ to "111110" by referring to the coding table 500.

The spatial information encoding unit 20 refers to a quantization table representing correspondences between values of the difference in intensity and index values. The spatial information encoding unit 20 determines an index value closest to the difference in intensity $CLD_j(k)$ (j=L, R, C, 1, 2) for each frequency band by referring to the quantization table. The spatial information encoding unit 20 calculates, for each frequency band, a difference value between index values in the frequency direction. For example, if the index value for the frequency band k is 2 and the index value for the frequency band (k-1) is 4, the spatial information encoding unit 20 determines the difference value between index values for the frequency band k as −2.

The spatial information encoding unit 20 refers to a coding table representing correspondences between difference values between index values and intensity difference codes. The spatial information encoding unit 20 determines an intensity difference code $idxcld_j(k)$ (j=L, R, C) for the difference value of the frequency band k in the case of the difference in intensity $CLD_j(k)$ by referring to the coding table. The intensity difference code may be, for example, as with the similarity code, a variable-length code whose code length becomes short as the frequency of occurrence of the difference value becomes high, such as a Huffman code or an arithmetic code. The quantization table and the coding table are stored in advance in the memory included in the spatial information encoding unit 20.

FIG. 6 is a diagram illustrating an example of the quantization table for differences in intensity. In a quantization table 600 illustrated in FIG. 6, each field in rows 610, 630, and 650 indicates an index value, and each field in rows 620, 640, and 660 indicates a typical value of the difference in intensity corresponding to the index value in the same column of the rows 610, 630, and 650, respectively. For example, if the difference in intensity $CLD_L(k)$ for the frequency band k is 10.8 dB, the typical value of the difference in intensity corresponding to an index value of 5 is the closest to the difference in intensity $CLD_L(k)$ in the quantization table 600. Therefore, the spatial information encoding unit 20 sets the index value for the difference in intensity $CLD_L(k)$ to 5.

The spatial information encoding unit 20 generates an MPS code using the similarity code $idxicc_i(k)$, the intensity difference code $idxcld_j(k)$, and the channel prediction coefficient code $idxc_m(k)$. For example, the spatial information encoding unit 20 generates the MPS code by arranging the similarity code $idxicc_i(k)$, the intensity difference code $idxcld_j(k)$, and the channel prediction coefficient code $idxc_m(k)$ in a certain order. The certain order is described, for example, in ISO/IEC 23003-1:2007. The spatial information encoding unit 20 outputs the generated MPS code to the multiplexing unit 21.

Figure 7:
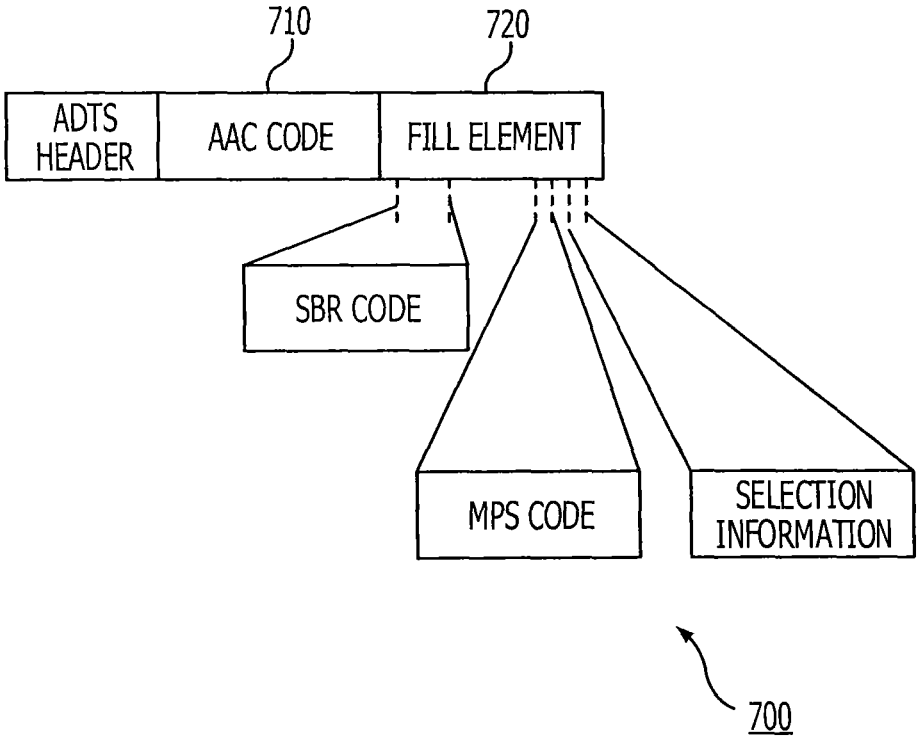
FIG. 7 is a diagram illustrating an example of a data format storing encoded audio signals.

The multiplexing unit 21 multiplexes the MC code, the SBR code, the MPS code, and the selection information by arranging these codes and the information in a certain order. The multiplexing unit 21 then outputs an encoded audio signal generated by the multiplexing. FIG. 7 is a diagram illustrating an example of a data format in which the encoded audio signal is stored. In the example illustrated in FIG. 7, the encoded audio signal is formed in accordance with an MPEG-4 Audio Data Transport Stream (ADTS) format. In an encoded data string 700 illustrated in FIG. 7, the MC code is stored in a data block 710. The SBR code, the MPS code, and the selection information are stored in a certain region of a block 720, in which a fill element in the ADTS format is stored.

Figure 8:
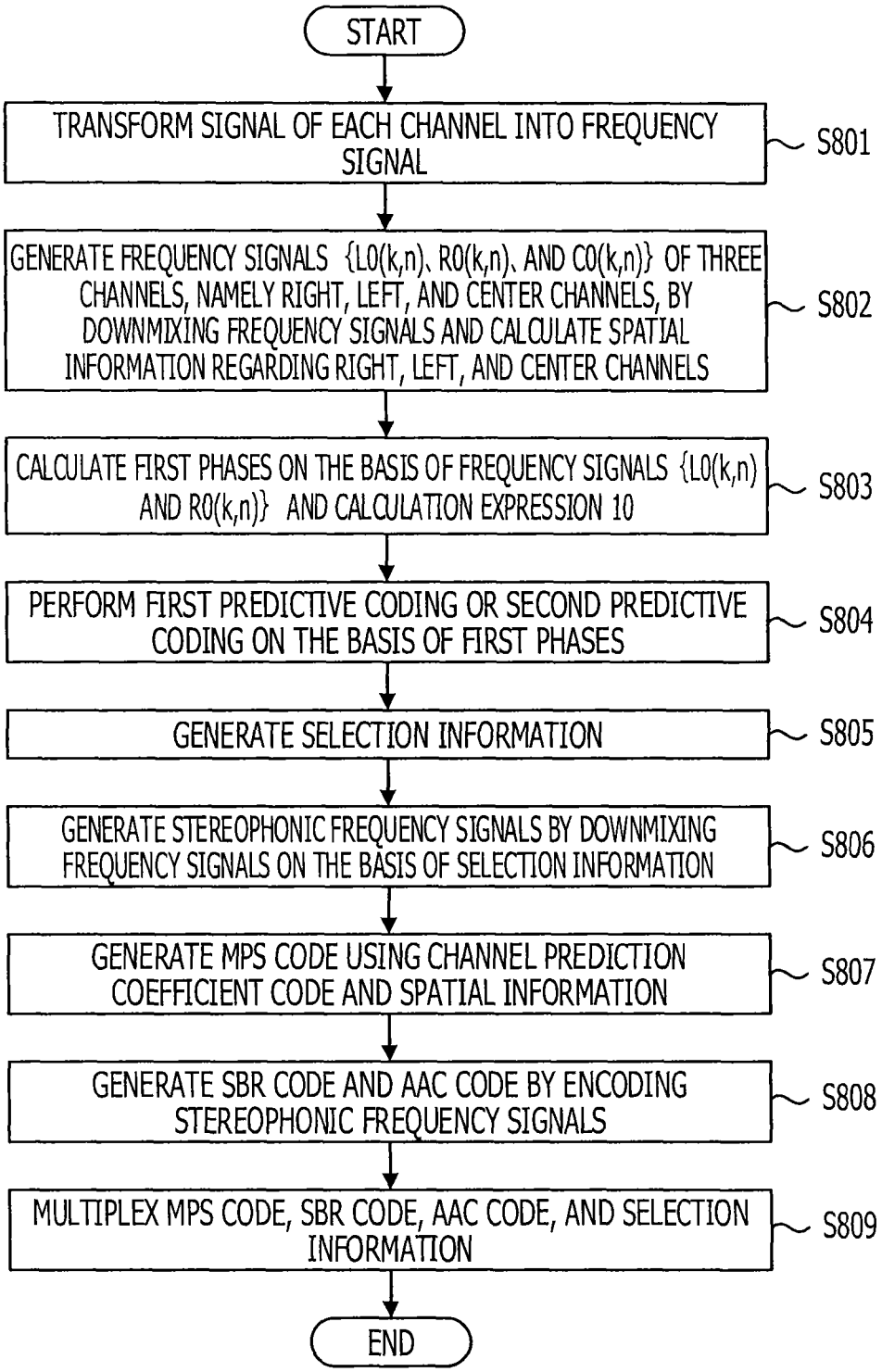
FIG. 8 is an operation flowchart illustrating an audio encoding process.

FIG. 8 is an operation flowchart illustrating an audio encoding process. The flowchart illustrated in FIG. 8 represents a process performed on multichannel audio signals of one frame. The audio encoding device 1 repeatedly performs the procedure of the audio encoding process illustrated in FIG. 8 for each frame while receiving multichannel audio signals.

The time-frequency transform unit 11 transforms the signal of each channel into a frequency signal (step S801). The time-frequency transform unit 11 then outputs the frequency signal of each channel to the first downmixing unit 12.

Next, the first downmixing unit 12 downmixes the frequency signal of each channel to generate frequency signals $L_0(k, n)$, $R_0(k, n)$, and $C_0(k, n)$ of three channels, namely right, left, and center channels. Furthermore, the first downmixing unit 12 calculates spatial information regarding the right, left, and center channels (step S802). The first downmixing unit 12 outputs the frequency signals of the three channels to the calculation unit 13 and the second downmixing unit 14.

The calculation unit 13 receives the frequency signals of the three channels, namely the left frequency signal $L_0(k, n)$, the right frequency signal $R_0(k, n)$, and the signal $C_0(k, n)$ of the center channel, from the first downmixing unit 12. The calculation unit 13 then calculates the first phases on the basis of the left frequency signal $L_0(k, n)$ and the right frequency signal $R_0(k, n)$ using the expression 10 (step S803). Furthermore, the calculation unit 13 outputs the first phases to the predictive coding unit 15. In step S803, the calculation unit 13 calculates the second phases and outputs the second phases to the predictive coding unit 15 as occasion calls.

The predictive coding unit 15 receives the first phases from the calculation unit 13. The predictive coding unit 15 also receives the second phases from the calculation unit 13 as occasion calls. The predictive coding unit 15 performs the first predictive coding or the second predictive coding on the basis of the first phases (step S804). More specifically, when the first phases are other than identical phases or opposite phases, the predictive coding unit 15 performs the first predictive coding. When the first phases are opposite phases or identical phases, the predictive coding unit 15 performs the second predictive coding. When the second phases have been received from the calculation unit 13, the predictive coding unit 15 compares the first phases and the second phases. When the first phases and the second phases are identical phases or opposite phases, the predictive coding unit 15 may perform the predictive coding on the signal $C_0(k, n)$ of the center channel on the basis of the right frequency signal $R_0(k, n)$ or the left frequency signal $L_0(k, n)$ using the expression 14 or 15.

Next, the predictive coding unit 15 generates selection information including information indicating that the first predictive coding or the second predictive coding has been performed as the predictive coding, and outputs the selection information to the second downmixing unit 14 and the multiplexing unit 21 (step S805). In S805, when the selection information includes the information indicating that the second predictive coding has been performed, the predictive coding unit 15 causes the selection information to further include information indicating which of the left frequency signal $L_0(k, n)$ and the right frequency signal $R_0(k, n)$ has been used in the predictive coding. When the predictive coding unit 15 has performed the predictive coding using the expression 14 or 15, the predictive coding unit 15 may cause the selection information to further include information indicating that the first predictive coding has been performed. In addition, in step S805, the predictive coding unit 15 outputs a channel prediction coefficient code encoded in the first predictive coding or the second predictive coding to the spatial information encoding unit 20.

The second downmixing unit 14 receives the selection information from the predictive coding unit 15. The second downmixing unit 14 downmixes the frequency signals of the three channels on the basis of the selection information to generate stereophonic frequency signals. The second downmixing unit 14 then outputs the stereophonic frequency signals to the channel signal encoding unit 16 (step S806). More specifically, when the selection information includes the information indicating that the first predictive coding has been performed, the second downmixing unit 14 outputs the left frequency signal $L_0(k, n)$ and the right frequency signal $R_0(k, n)$ to the channel signal encoding unit 16. When the selection information includes the information indicating that the second predictive coding has been performed, the second downmixing unit 14 outputs the signal $C_0(k, n)$ of the center channel and either the left frequency signal $L_0(k, n)$ or the right frequency signal $R_0(k, n)$ to the channel signal encoding unit 16.

The spatial information encoding unit 20 generates an MPS code from the spatial information to be encoded received from the first downmixing unit 12 and the channel prediction coefficient code received from the predictive coding unit 15 (step S807). The spatial information encoding unit 20 then outputs the MPS code to the multiplexing unit 21.

The channel signal encoding unit 16 performs the SBR encoding on a high-frequency component of the received stereophonic frequency signal of each channel. In addition, the channel signal encoding unit 16 performs the MC encoding on a low-frequency component, which is not subjected to the SBR encoding, of the received stereophonic frequency signal of each channel (step S808). The channel signal encoding unit 16 outputs, to the multiplexing unit 21, an SBR code and an MC code including information indicating the positional relationship between the low-frequency component used for the replication and the corresponding high-frequency component.

Finally, the multiplexing unit 21 multiplexes the SBR code, the MC code, the MPS code, and the selection information that have been generated, in order to generate an encoded audio signal (step S809). The multiplexing unit 21 outputs the encoded audio signal. The audio encoding device 1 then ends the encoding process.

The audio encoding device 1 may perform the processing in step S807 and the processing in step S808 in parallel with each other. Alternatively, the audio encoding device 1 may perform the processing in step S808 before performing the processing in step S807.

Figure 9:
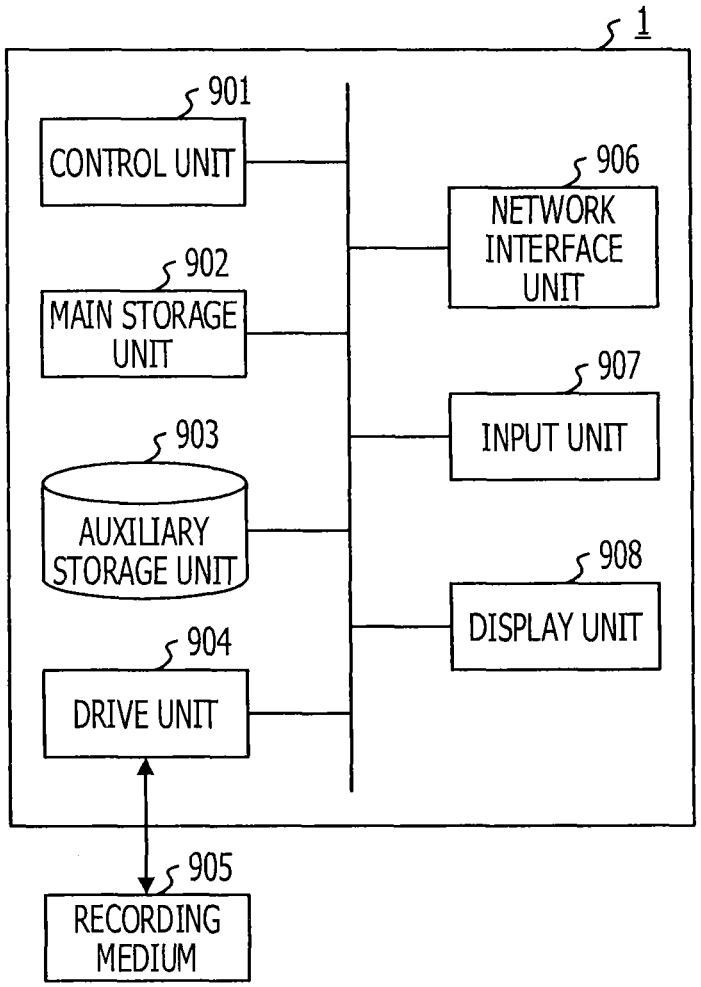
FIG. 9 is a block diagram illustrating an audio encoding device according to another embodiment.

FIG. 9 is a block diagram illustrating an audio encoding device according to another embodiment. As illustrated in FIG. 9, an audio encoding device 1 includes a control unit 901, a main storage unit 902, an auxiliary storage unit 903, a drive unit 904, a network interface unit 906, an input unit 907, and a display unit 908. These components are connected to one another through a bus in such a way as to enable transmission and reception of data.

The control unit 901 is a central processing unit (CPU) that controls other components and that calculates and processes data in a computer. The control unit 901 is an arithmetic device that executes programs stored in the main storage unit 902 and the auxiliary storage unit 903. The control unit 901 receives data from the input unit 907 or a storage device, calculates or processes the data, and outputs the data to the display unit 908 or the storage device.

The main storage unit 902 is a read-only memory (ROM), a random-access memory (RAM), or the like, and is a storage device that stores or temporarily saves programs and data such as an operating system (OS), which is basic software, and application software executed by the control unit 901.

The auxiliary storage unit 903 is a hard disk drive (HDD), and is a storage device that stores data relating to the application software and the like.

The drive unit 904 reads a program from a recording medium 905, namely, for example, a flexible disk, and installs the program in the auxiliary storage unit 903.

The recording medium 905 stores a certain program, and the certain program stored in the recording medium 905 is installed in the audio encoding device 1 through the drive unit 904. The installed certain program may be executed by the audio encoding device 1.

The network interface unit 906 is an interface between a peripheral device having a communication function connected through a network such as a local area network (LAN) or a wide area network (WAN) constructed by a data transmission path such as a wired line and/or a wireless line and the audio encoding device 1.

The input unit 907 includes a cursor key, a keyboard including numeric keys and various function keys, and a mouse, a touchpad, or the like for selecting a key on a display screen of the display unit 908. The input unit 907 is a user interface for the user to provide an operation instruction and input data to the control unit 901.

The display unit 908 includes a cathode ray tube (CRT) or a liquid crystal display (LCD), and displays display data input from the control unit 901.

The above-described audio encoding process may be realized as a program to be executed by the computer. By installing this program from a server or the like and causing the computer to executing the program, the above-described audio encoding process may be realized.

The program may be recorded on the recording medium 905, and the recording medium 905 on which the program is recorded may be read by the computer or a mobile terminal in order to realize the above-described audio encoding process. The recording medium 905 may be one of various types of recording media including recording media that optically, electrically, or magnetically records information, such as a compact disc read-only memory (CD-ROM), a flexible disk, and a magneto-optical disk, and semiconductor memories that electrically record information, such as a ROM and a flash memory.

Figure 10A:
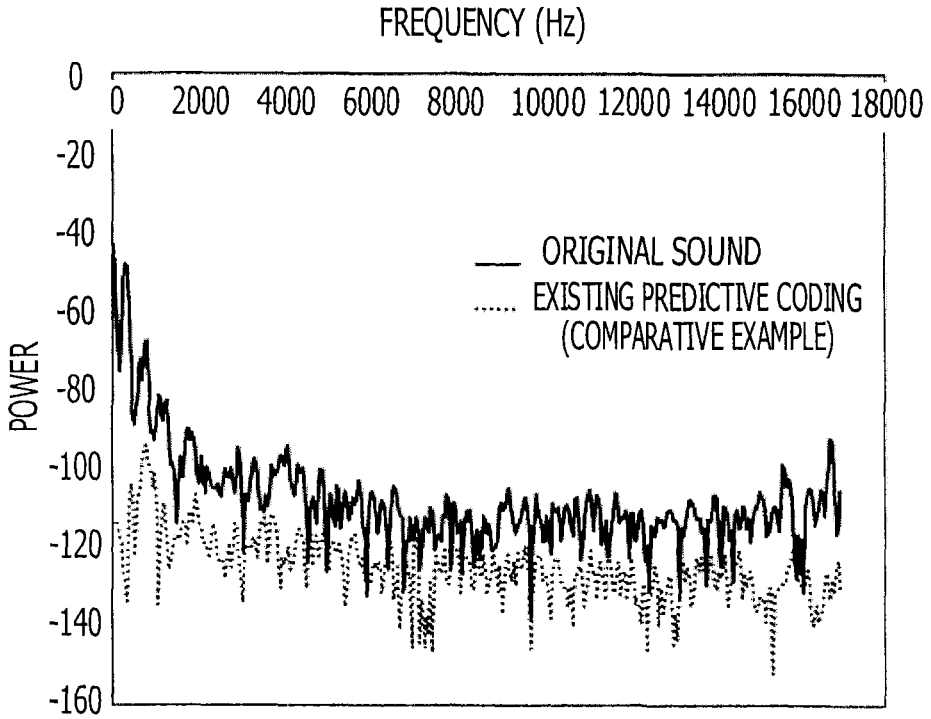
FIG. 10A illustrates power frequency characteristics of an original sound of multichannel audio signals and an audio signal for which existing predictive coding has been used (comparative example)
Figure 10B:
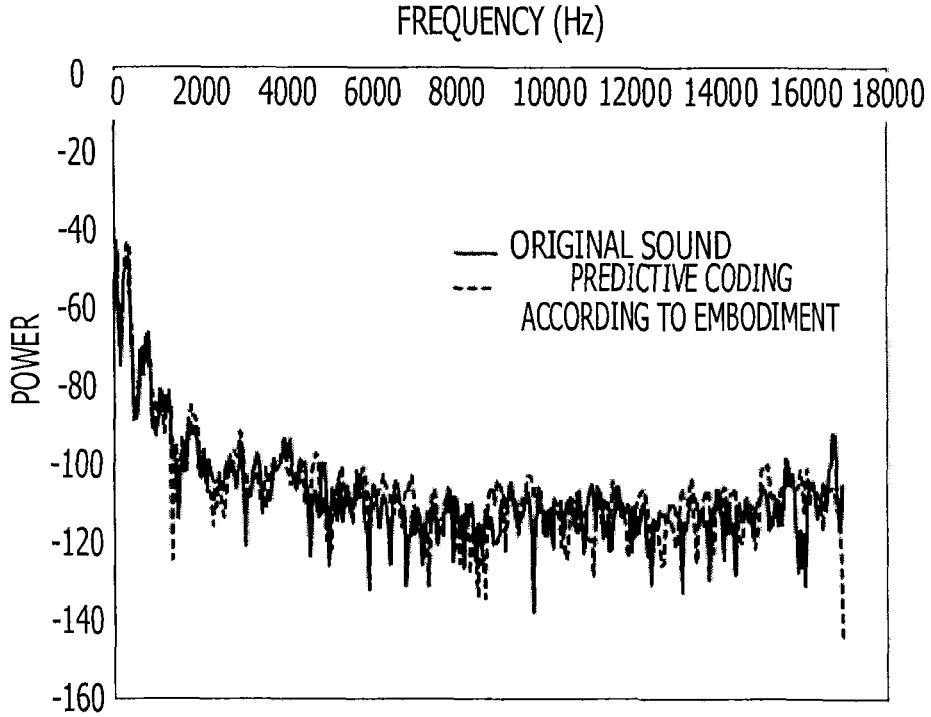
FIG. 10B illustrates power frequency characteristics of an original sound of multichannel audio signals and an audio signal for which predictive coding according to the embodiment has been performed.

FIG. 10A illustrates power-frequency characteristics of an original sound of multichannel audio signals and an audio signal for which existing predictive coding has been used (comparative example). FIG. 10B illustrates power-frequency characteristics of an original sound of multichannel audio signals and an audio signal for which the predictive coding according to the present embodiment has been used. In FIGS. 10A and 10B, the left frequency signal $L_0(k, n)$ and the right frequency signal $R_0(k, n)$ have identical phases and the signal $C_0(k, n)$ of the center channel is subjected to the predictive coding.

As may be seen from FIG. 10A, in the existing predictive coding, a deviation from the original sound is significant and an error caused by the predictive coding is significantly large, and therefore the quality of the sound is deteriorated. On the other hand, as may be seen from FIG. 10B, in the predictive coding according to the present embodiment, the power is substantially the same as that of the original sound and the deterioration of the quality of the sound caused by the predictive coding may be suppressed.

(Second Embodiment) When the second predictive coding is to be performed, the predictive coding unit 15 illustrated in FIG. 1 may perform the predictive coding on either the left frequency signal $L_0(k, n)$ or the right frequency signal $R_0(k, n)$ using both the left frequency signal $L_0(k, n)$ and the right frequency signal $R_0(k, n)$. For example, when the predictive coding is to be performed on the right frequency signal $R_0(k, n)$, a right frequency signal $R'_0(k, n)$ after the predictive coding may be represented by the following expressions:

$$d(k) = \sum_k \sum_n \{|R_0(k, n) - R'_0(k, n)|^2\} \tag{17}$$

$$R'_0(k, n) = c_1(k) \cdot L_0(k, n) + c_2(k) \cdot C_0(k, n)$$

However, $c_2(k)=0$

In this case, the predictive coding unit 15 selects the channel prediction coefficient $c_1(k)$ with which the error d(k) becomes smallest and 0, which is the channel prediction coefficient of $c_2(k)$. Because the same method may be used in a case in which the predictive coding is to be performed on the left frequency signal $L_0(k, n)$ or in a case in which the first phases and the second phases are identical phases or opposite phases and the predictive coding is to be performed on the signal $C_0(k, n)$ of the center channel, detailed description of the method is omitted.

(Third Embodiment) Although the cosine function $\cos\theta_1$ of the vector of the left frequency signal $L_0(k, n)$ and the vector of the right frequency signal $R_0(k, n)$ is 180° and the first phases are opposite phases in FIG. 3B, the calculation unit 13 may add a certain angle to 180° as a margin and define the resultant angle as the opposite phases. For example, the margin may be set to ±5, and the range of 175° to 185° may be virtually determined as the opposite phases. In this case, for example, when the predictive coding is to be performed on the right frequency signal $R_0(k, n)$, the right frequency signal $R'_0(k, n)$ after the predictive coding may be represented by the following expressions:

$$d(k) = \sum_k \sum_n \{|R_0(k, n) - R'_0(k, n)|^2\} \tag{18}$$

$$R'_0(k, n) = c_1(k) \cdot L_0(k, n) + c_2(k) \cdot C_0(k, n)$$

This is because, as illustrated in FIG. 2, only a limited number of channel prediction coefficients are included in the code book and therefore the number of coefficients used to combine the vectors illustrated in FIGS. 3A to 3C is limited. In other words, this is because, in the audio encoding, a case may be assumed in which the error calculated by the expression 18 is smaller than the error calculated by the expression 12. When the right frequency signal $R_0(k, n)$ and the left frequency signal $L_0(k, n)$ generated by the audio encoding device 1 are expressed by vectors, the margin angle may be determined, for example, by a simulation or the like that uses the average magnitude and orientation of the vectors, the channel prediction coefficients included in the code book, and the error d(k) as parameters. Because the same method may be used in a case in which the predictive coding is to be performed on the left frequency signal $L_0(k, n)$ and a case in which the first phases and the second phases are identical phases or opposite phases and the predictive coding is to be performed on the signal $C_0(k, n)$ of the center channel, detailed description of the method is omitted. In addition, as illustrated in FIG. 3C, the margin may be set in the same manner as above when the first phases are identical phases. For example, the margin may be set to ±5, and the range of −5° to 5° may be virtually determined as the identical phases. Other specific methods are the same as in the case of the opposite phases, and therefore detailed description thereof is omitted.

According to yet another embodiment, the channel signal encoding unit of the audio encoding device may encode stereophonic frequency signals using another encoding method, instead. For example, the channel signal encoding unit may encode all the frequency signals using the MC encoding method. In this case, the SBR encoding section 17 is omitted in the audio encoding device 1 illustrated in FIG. 1.

Multichannel audio signals to be subjected to the encoding are not limited to 5.1ch audio signals. For example, audio signals to be subjected to the encoding may be audio signals of a plurality of channels, namely 3ch, 3.1ch, or 7.1ch. In this case, too, the audio encoding device calculates a frequency signal of each channel by performing the time-frequency transform on the audio signal of each channel. The audio encoding device then downmixes the frequency signal of each channel to generate frequency signals of a number of channels smaller than the number of the original audio signals.

A computer program for causing the computer to realize the function of each component included in the audio encoding device according to each of the above embodiments may be stored in a recording medium such as a semiconductor memory, a magnetic recording medium, or an optical recording medium, and provided.

The audio encoding device according to each of the above embodiments may be mounted on various apparatuses used to transmit or record audio signals, such as a computer, a recording apparatus of video signals, and video transmission apparatus.

Figure 11:
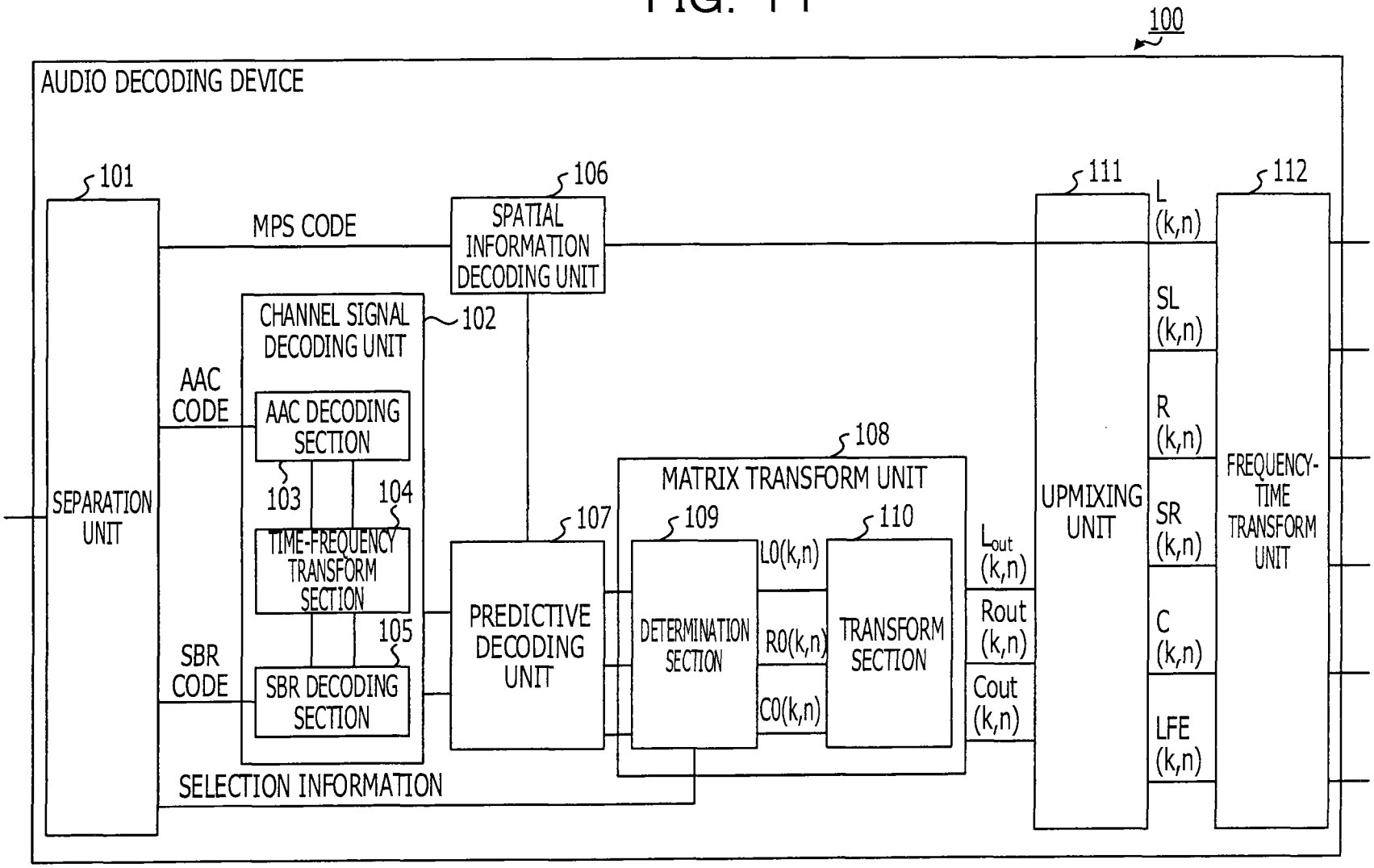
FIG. 11 is a diagram illustrating the functional blocks of an audio decoding device according to an embodiment.

(Fourth Embodiment) FIG. 11 is a diagram illustrating the functional blocks of an audio decoding device 100 according to an embodiment. As illustrated in FIG. 11, an audio decoding device 100 includes a separation unit 101, a channel signal decoding unit 102, a spatial information decoding unit 106, a predictive decoding unit 107, a matrix transform unit 108, an upmixing unit 111, and a frequency-time transform unit 112. The channel signal decoding unit 102 includes an MC decoding section 103, a time-frequency transform section 104, and an SBR decoding section 105. The matrix transform unit 108 includes a determination section 109 and a transform section 110.

These components included in the audio decoding device 100 are formed as separate circuits. Alternatively, these components included in the audio decoding device 100 may be mounted on the audio decoding device 100 as a single integrated circuit in which circuits corresponding thereto are integrated with one another. Alternatively, these components included in the audio decoding device 100 may be function modules realized by a computer program executed by a processor included in the audio decoding device 100.

The separation unit 101 receives an encoded audio signal that has been multiplexed from the outside. The separation unit 101 separates the selection information and the MC code, the SBR code, and the MPS that have been encoded included in the encoded audio signal from one another. The MC code and the SBR code may be referred to as channel encoded signals, and the MPS code may be referred to as encoded spatial information. As a separation method, the method described in ISO/IEC 14496-3 may be used. The separation unit 101 outputs the separated MPS code to the spatial information decoding unit 106, the MC code to the MC decoding section 103, the SBR code to the SBR decoding section 105, and the selection information to the determination section 109.

The spatial information decoding unit 106 receives the MPS code from the separation unit 101. The spatial information decoding unit 106 decodes the MPS code using an example of the quantization table for the degrees of similarity illustrated in FIG. 4 in order to generate the degree of similarity $ICC_i(k)$, and outputs the degree of similarity $ICC_i(k)$ to the upmixing unit 111. In addition, the spatial information decoding unit 106 decodes the MPS code using an example of the quantization table for the differences in intensity illustrated in FIG. 6 in order to generate the difference in intensity $CLD_j(k)$, and outputs the difference in intensity $CLD_j(k)$ to the upmixing unit 111. In addition, the spatial information decoding unit 106 decodes the MPS code using an example of the quantization table for the channel prediction coefficients illustrated in FIG. 2 in order to generate the channel prediction coefficients, and outputs the channel prediction coefficients to the predictive decoding unit 107.

The MC decoding section 103 receives the MC code from the separation unit 101, and then decodes the low-frequency component of the signal of each channel using an MC decoding method and outputs the resultant signals to the time-frequency transform section 104. The MC decoding method may be, for example, the method described in ISO/IEC 13818-7.

The time-frequency transform section 104 transforms the signal of each channel, which is a time signal decoded by the MC decoding section 103, into a frequency signal using, for example, the QMF bank described in ISO/IEC 14496-3, and outputs the frequency signal to the SBR decoding section 105. Alternatively, the time-frequency transform section 104 may perform the time-frequency transform using a complex QMF bank represented by the following expression:

$$QMF(k, n) = \exp\left(j\frac{\pi}{128}(k+0.5)(2n+1)\right), \quad 0 \le k < 64,\ 0 \le n < 128 \tag{19}$$

Here, QMF(k, n) is a complex QMF having the time n and the frequency k as variables.

The SBR decoding section 105 decodes the high-frequency component of the signal of each channel using an SBR decoding method. The SBR decoding method may be, for example, the method described in ISO/IEC 14496-3.

The channel signal decoding unit 102 outputs the stereophonic frequency signal of each channel decoded by the MC decoding section 103 and the SBR decoding section 105 to the predictive decoding unit 107.

The predictive decoding unit 107 performs predictive decoding on the left frequency signal $L_0(k, n)$, the right frequency signal $R_0(k, n)$, or the signal $C_0(k, n)$ of the center channel that has been subjected to the predictive coding, on the basis of the channel prediction coefficients received from the spatial information decoding unit 106 and the stereophonic frequency signals received from the channel signal decoding unit 102. For example, when the predictive decoding unit 107 is to perform the predictive decoding on the signal $C_0(k, n)$ of the center channel using the stereophonic frequency signals, namely the left frequency signal $L_0(k, n)$ and the right frequency signal $R_0(k, n)$, and the channel prediction coefficients $c_1(k)$ and $c_2(k)$, the predictive decoding may be performed using the following expression:

$$C_0(k, n) = c_1(k) \cdot L_0(k, n) + c_2(k) \cdot R_0(k, n) \tag{20}$$

The predictive decoding unit 107 may perform only the predictive decoding using the channel prediction coefficients received from the spatial information decoding unit 106 and the stereophonic frequency signals received from the channel signal decoding unit 102, and does not have to recognize which of the left frequency signal $L_0(k, n)$, the right frequency signal $R_0(k, n)$, and the signal $C_0(k, n)$ of the center channel the predictive decoding has been performed for. This is because the determination section 109, which will be described later, may recognize that on the basis of the selection information.

The determination section 109 determines, among the left frequency signal $L_0(k, n)$, the right frequency signal $R_0(k, n)$, and the signal $C_0(k, n)$ of the center channel, the stereophonic frequency signals and the signal that has been subjected to the predictive decoding on the basis of the selection information received from the separation unit 101, and outputs the left frequency signal $L_0(k, n)$, the right frequency signal $R_0(k, n)$, and the signal $C_0(k, n)$ of the center channel to the transform section 110 in a certain arrangement. The certain arrangement is an arrangement in which, for example, the left frequency signal $L_0(k, n)$, the right frequency signal $R_0(k, n)$, and the signal $C_0(k, n)$ of the center channel are arranged in this order from the top as illustrated in FIG. 11.

The transform section 110 performs a matrix transform on the left frequency signal $L_0(k, n)$, the right frequency signal $R_0(k, n)$, and the signal $C_0(k, n)$ of the center channel received from the determination section 109 in the certain arrangement using the following expression:

$$\begin{pmatrix} L_{out}(k, n) \\ R_{out}(k, n) \\ C_{out}(k, n) \end{pmatrix} = \frac{1}{3}\begin{pmatrix} 2 & -1 & 1 \\ -1 & 2 & 1 \\ \sqrt{2} & \sqrt{2} & -\sqrt{2} \end{pmatrix}\begin{pmatrix} L_0(k, n) \\ R_0(k, n) \\ C_0(k, n) \end{pmatrix} \tag{21}$$

Here, $L_{out}(k, n)$, $R_{out}(k, n)$, and $C_{out}(k, n)$ denote the frequency signals of the left channel, the right channel, and the center channel, respectively. The matrix transform unit 108 outputs the frequency signal $L_{out}(k, n)$ of the left channel, the frequency signal $R_{out}(k, n)$ of the right channel, and the frequency signal $C_{out}(k, n)$ of the center channel subjected to the matrix transform in the transform section 110 to the upmixing unit 111.

The upmixing unit 111 upmixes the frequency signal $L_{out}(k, n)$ of the left channel, the frequency signal $R_{out}(k, n)$ of the right channel, and the frequency signal $C_{out}(k, n)$ of the center channel on the basis of the spatial information received from the spatial information decoding unit 106 and the frequency signal $L_{out}(k, n)$ of the left channel, the frequency signal $R_{out}(k, n)$ of the right channel, and the frequency signal $C_{out}(k, n)$ of the center channel received from the matrix transform unit 108, in order to generate, for example, 5.1ch audio signals. The upmixing method may be, for example, the method described in ISO/IEC 23003-1.

The frequency-time transform unit 112 transforms each signal received from the upmixing unit 111 from the frequency signal to a time signal using a QMF bank represented by the following expression:

$$IQMF(k, n) = \frac{1}{64}\exp\left(j\frac{\pi}{64}\left(k + \frac{1}{2}\right)(2n - 127)\right), \quad (22)$$

$$0 \le k < 32,\ 0 \le n < 32$$

Thus, the audio decoding device disclosed in the fourth embodiment may accurately decode the audio signal that has been subjected to the predictive coding and whose error has been suppressed.

Figure 12:
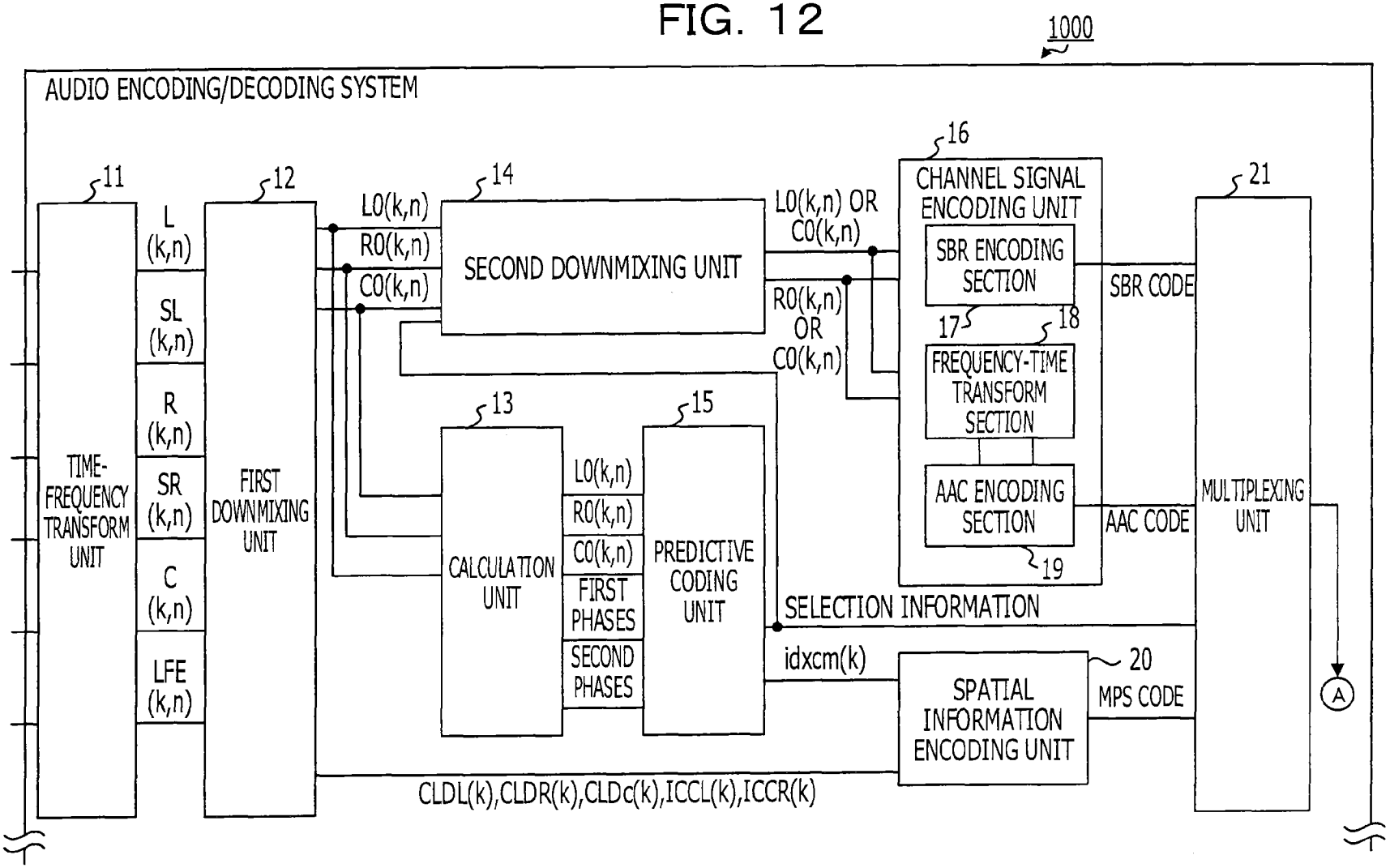
FIG. 12 is a first diagram illustrating the functional blocks of an audio encoding/decoding system according to an embodiment.
Figure 13:
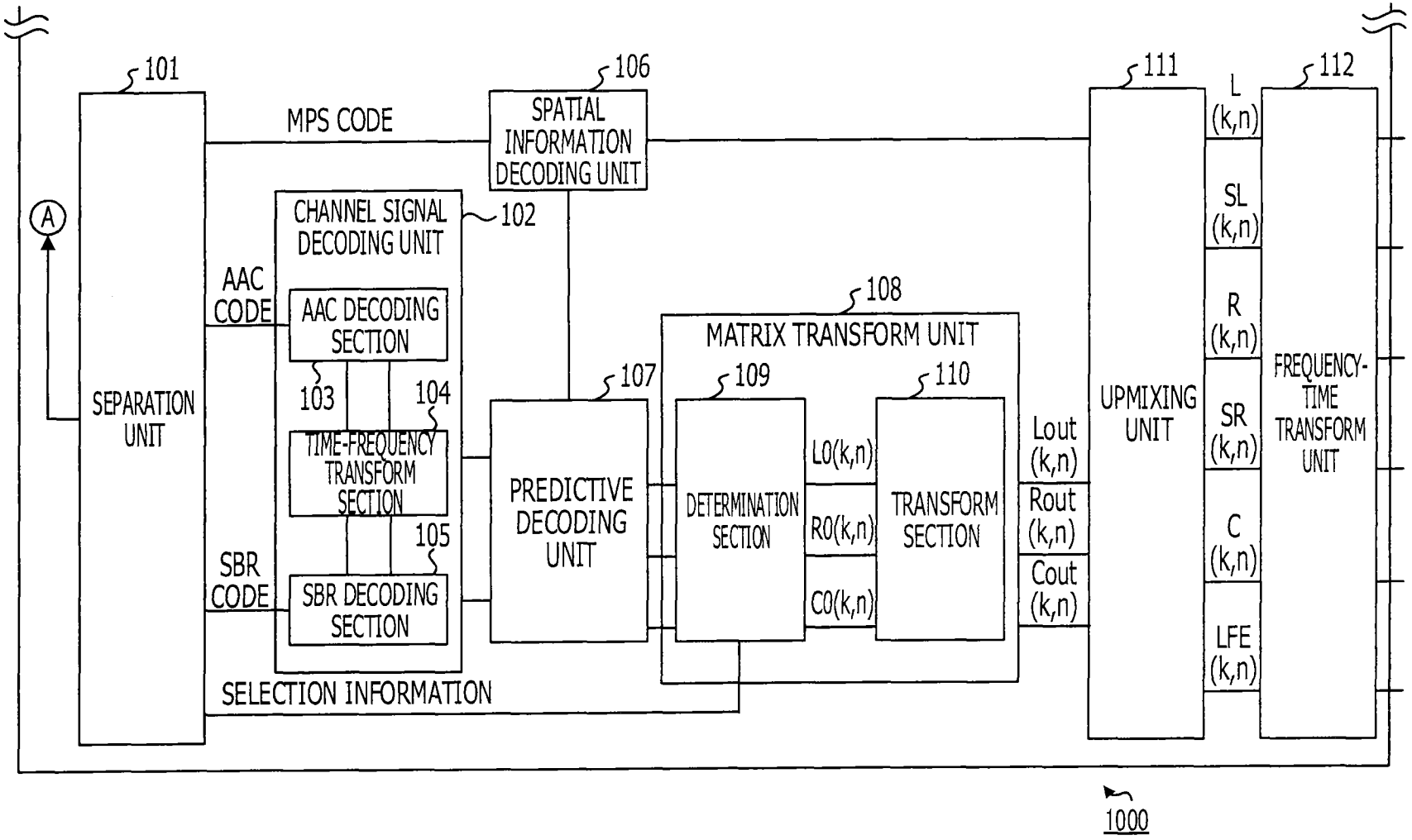
FIG. 13 is a second diagram illustrating the functional blocks of the audio encoding/decoding system according to the embodiment.

(Fifth Embodiment) FIG. 12 is a first diagram illustrating the functional blocks of an audio encoding/decoding system 1000 according to an embodiment. FIG. 13 is a second diagram illustrating the functional blocks of the audio encoding/decoding system 1000 according to the embodiment. As illustrated in FIGS. 12 and 13, the audio encoding/decoding system 1000 includes a time-frequency transform unit 11, a first downmixing unit 12, a calculation unit 13, a second downmixing unit 14, a predictive coding unit 15, a channel signal encoding unit 16, a spatial information encoding unit 20, and a multiplexing unit 21. The channel signal encoding unit 16 includes an SBR encoding section 17, a frequency-time transform section 18, and an MC encoding section 19. The audio encoding/decoding system 1000 further includes a separation unit 101, a channel signal decoding unit 102, a spatial information decoding unit 106, a predictive decoding unit 107, a matrix transform unit 108, an upmixing unit 111, and a frequency-time transform unit 112. The channel signal decoding unit 102 includes an MC decoding section 103, a time-frequency transform section 104, and an SBR decoding section 105. The matrix transform unit 108 includes a determination section 109 and a transform section 110. The functions of the audio encoding/decoding system 1000 are the same as those illustrated in FIG. 1 and FIG. 11, and therefore detailed description thereof is omitted.

In the above embodiments, the components of each device illustrated in the drawings do not have to be physically configured as illustrated. That is, specific modes of separating and integrating each device are not limited to those illustrated in the drawings, and the entirety or a part of each device may be functionally or physically separated or integrated in arbitrary units in accordance with various loads and usage conditions.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio encoding device comprising:

a processor; and a memory which stores a plurality of instructions, which when executed by the processor, cause the processor to:

calculate first phases indicating phases of a first channel signal and a second channel signal included in audio signals of a plurality of channels; and perform, on a basis of the first phases, either first predictive coding in which a third channel signal included in the audio signals of the plurality of channels is predicted using the first channel signal and the second channel signal or second predictive coding in which the second channel signal is predicted using the first channel signal, wherein when the first phases are other than identical phases or opposite phases, the first predictive coding is performed, and when the first phases are identical phases or opposite phases, the second predictive coding is performed.

2. The audio encoding device according to claim 1, wherein the processor is further configured to generate selection information indicating that the first predictive coding or the second predictive coding has been performed as predictive coding.

3. The audio encoding device according to claim 2, wherein the processor is further configured to:

multiplex the selection information.

4. The audio encoding device according to claim 1, wherein the processor is further configured to:

generate, on a basis of selection information, either a first stereophonic frequency signal from the first channel signal and the second channel signal or a second stereophonic frequency signal from the first channel signal and the third channel signal.

5. The audio encoding device according to claim 1, wherein the processor is further configured to:

calculate second phases indicating phases of the third channel signal and either the first channel signal or the second channel signal, and perform predictive coding on the third channel signal using either the first channel signal or the second channel signal when the first phases and the second phases are identical phases and opposite phases.

6. The audio encoding device according to claim 1, wherein the processor is further configured to:

predict the second channel signal using the third channel signal in the second predictive coding.

7. The audio encoding device according to claim 1, wherein the first predictive coding or the second predictive coding uses a plurality of channel prediction coefficients included in a code book.

8. The audio encoding device according to claim 1, wherein when the second predictive coding is to be performed, a first error defined by a difference between the second channel signal after a predictive coding and the second channel signal before the predictive coding and a second error defined by a difference between the first channel signal after the predictive coding, which is obtained by predicting the first channel signal using the second channel signal, and the first channel signal before the predictive coding are calculated, and the first error and the second error are compared, and, if the second error is smaller than the first error, not the second channel signal is predicted using the first channel signal but the first channel signal is predicted using the second channel signal.

9. An audio encoding method comprising:

calculating, by a computer processor, first phases indicating phases of a first channel signal and a second channel signal included in audio signals of a plurality of channels; and performing, on a basis of the first phases, either first predictive coding in which a third channel signal included in the audio signals of the plurality of channels is predicted using the first channel signal and the second channel signal or second predictive coding in which the second channel signal is predicted using the first channel signal, wherein when the first phases are other than identical phases or opposite phases, the first predictive coding is performed in the performing, and when the first phases are identical phases or opposite phases, the second predictive coding is performed in the performing.

10. The audio encoding method according to claim 9, wherein, in the performing, selection information indicating that the first predictive coding or the second predictive coding has been performed as predictive coding is generated.

11. The audio encoding method according to claim 9, further comprising:

generating, on a basis of selection information, either a first stereophonic frequency signal from the first channel signal and the second channel signal or a second stereophonic frequency signal from the first channel signal and the third channel signal.

12. The audio encoding method according to claim 9, wherein, in the calculating, second phases indicating phases of the third channel signal and either the first channel signal or the second channel signal is further calculated, and wherein, in the performing, when the first phases and the second phases are identical phases and opposite phases, predictive coding is performed on the third channel signal using either the first channel signal or the second channel signal.

13. The audio encoding method according to claim 9, wherein, in the performing, the second channel signal is predicted further using the third channel signal in the second predictive coding.

14. The audio encoding method according to claim 9, wherein in the performing, the first predictive coding or the second predictive coding uses a plurality of channel prediction coefficients included in a code book.

15. The audio encoding method according to claim 9, wherein, in the performing, when the second predictive coding is to be performed, a first error defined by a difference between the second channel signal after a predictive coding and the second channel signal before the predictive coding and a second error defined by a difference between the first channel signal after the predictive coding, which is obtained by predicting the first channel signal using the second channel signal, and the first channel signal before the predictive coding are calculated, and wherein the first error and the second error are compared, and, if the second error is smaller than the first error, not the second channel signal is predicted using the first channel signal but the first channel signal is predicted using the second channel signal.

16. A non-transitory computer-readable storage medium storing an audio encoding computer program that causes a computer to execute a process comprising:

calculating first phases indicating phases of a first channel signal and a second channel signal included in audio signals of a plurality of channels; and performing, on a basis of the first phases, either first predictive coding in which a third channel signal included in the audio signals of the plurality of channels is predicted using the first channel signal and the second channel signal or second predictive coding in which the second channel signal is predicted using the first channel signal, wherein when the first bases are other than identical phases or opposite phases, the first predictive coding is performed in the performing, and when the first phases are identical phases or opposite phases, the second predictive coding is performed in the performing.

17. An audio decoding device comprising:

a processor; and a memory which stores a plurality of instructions, which when executed by the processor, cause the processor to:

separate a plurality of information from a multiplexed signal, the plurality of information comprising:

encoded channel signals based on audio signals of a plurality of channels, encoded spatial information includes degree of similarity and difference in intensity for the plurality of channels, and selection information indicates that either first predictive coding as predictive coding in which a third channel signal is predicted using a first channel signal and a second channel signal, or second predictive coding as predictive coding in which the second channel signal is predicted using the first channel signal, transform, by a matrix transform, the first channel signal, the second channel and the third channel signal, wherein the first predictive coding is performed when first phases are other than identical phases or opposite phases, the second predictive coding is performed when the first phases are identical phases or opposite phases, and the first phases indicate phases of the first channel signal and the second channel signal included in the audio signals of the plurality of channels.

18. The audio decoding device according to claim 17, wherein the processor is further configured to:

generate stereophonic frequency signals by decoding the encoded channel signals;

generate spatial information by decoding encoded spatial information; and predictive decode any of the first channel signal, the second channel and the third channel signal.

* * * * *